US008356541B2

(12) United States Patent
Schneider et al.

(10) Patent No.: US 8,356,541 B2
(45) Date of Patent: Jan. 22, 2013

(54) VEHICLE PROTECTIVE STRUCTURE

(75) Inventors: John Schneider, Huntingburg, IN (US); Christopher Brown, Bloomington, IN (US); Robin Cromwell, Mitchell, IN (US); Donald Lowe, San Antonio, TX (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 192 days.

(21) Appl. No.: 12/857,223

(22) Filed: Aug. 16, 2010

(65) Prior Publication Data

US 2011/0197747 A1 Aug. 18, 2011

Related U.S. Application Data

(63) Continuation-in-part of application No. 12/844,899, filed on Jul. 28, 2010, now Pat. No. 8,146,480, which is a continuation of application No. 11/998,977, filed on Nov. 10, 2007, now Pat. No. 7,823,498.

(51) Int. Cl.
*F41H 7/02* (2006.01)

(52) U.S. Cl. ..... 89/36.08; 89/930; 89/935

(58) Field of Classification Search ..... 89/36.07, 89/36.08, 930, 931, 935
See application file for complete search history.

(56) References Cited

U.S. PATENT DOCUMENTS

| | | | | |
|---|---|---|---|---|
| 1,928,306 | A | 9/1933 | Brennan | |
| 2,388,873 | A | 11/1945 | Schwab | |
| 2,436,374 | A | 2/1948 | Birdsall | |
| 2,685,233 | A * | 8/1954 | Rose | 89/37.17 |
| 3,586,236 | A | 6/1971 | Schaffler | |
| 3,942,598 | A | 3/1976 | Council | |
| 4,358,984 | A | 11/1982 | Winblad | |
| 4,715,263 | A | 12/1987 | Kramer | |
| 4,934,246 | A | 6/1990 | Benson et al. | |
| 5,815,302 | A | 9/1998 | McVey et al. | |
| 5,942,716 | A | 8/1999 | Miller | |
| 6,302,010 | B1 | 10/2001 | Holler | |
| 6,622,607 | B1 | 9/2003 | Miller | |

(Continued)

OTHER PUBLICATIONS

ArmorHoldings.com, http://adg.armorholdings.com/pdfs/Improved%20Gunner%20Protection%20Kit.pdf, viewed Oct. 29, 2007.

Picatinny Designs Latest Advancement in Gunner Protection, http://www.pica.army.mil/PicatinnyPublic/warfighter/index.asp, dated Mar. 29, 2007, viewed Oct. 29, 2007.

(Continued)

*Primary Examiner* — Stephen M Johnson

(74) *Attorney, Agent, or Firm* — Christopher A. Monsey

(57) ABSTRACT

A protective structure for a vehicle having an opening on an upper surface is provided. One embodiment of the invention has at least a partial enclosure around an area defined laterally by the vehicle opening with an overhead and side protective capability. An embodiment of the invention has an overhead cover that is formed to substantially enclose a top area of the enclosure and having multiple panels that may be locked into place or opened by an occupant for exit through a top area of the enclosure. Biasing devices may be provided to bias the panels toward an open position and thereby facilitate occupant egress. The multiple panels in this embodiment extend upwardly and inwardly from a section of the enclosure's side walls. Ballistic windows are provided on the protective structure such that an occupant can view laterally and vertically through the enclosure and overhead cover. A shield or protective plate can be mounted on one side of the enclosure.

11 Claims, 21 Drawing Sheets

U.S. PATENT DOCUMENTS

| | | | | |
|---|---|---|---|---|
| 7,325,475 | B2 | 2/2008 | Long | |
| D622,182 | S | 8/2010 | Parimi et al. | |
| 7,895,932 | B1 * | 3/2011 | Ohnstad | 89/36.13 |
| 2005/0188831 | A1 | 9/2005 | Squires | |
| 2007/0000377 | A1 | 1/2007 | Ohnstad | |
| 2007/0131103 | A1 | 6/2007 | McClellan | |

OTHER PUBLICATIONS

Patrick A. Serao, http://www.dtic.mil/ndia/2007armaments/Serao.pdf, Jun. 12, 2007, p. 7, viewed Oct. 29, 2007.

* cited by examiner

VEHICLE PROTECTIVE STRUCTURE

CROSS-REFERENCE TO RELATED APPLICATION

This application is a continuation-in-part of U.S. patent application Ser. No. 12/844,899, filed Jul. 28, 2010 now U.S. Pat. No. 8,146,480, which is a continuation of U.S. patent application Ser. No. 11/998,977, filed Nov. 10, 2007 now U.S. Pat. No. 7,823,498, the disclosures of which are expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used, licensed by or for the United States Government for any governmental purpose without payment of any royalties thereon.

FIELD OF THE INVENTION

The invention generally relates to protective structures. In particular, the invention relates to protective structures used for protection against projectiles.

BACKGROUND OF THE INVENTION

The invention relates to protective structures. There is a significant need for the invention as there are no protective structures available or known which provide the features and benefits of the invention.

SUMMARY OF THE INVENTION

The invention relates to protective structures. The invention relates to protective structures adapted to protect against projective weapons or fragments that in one embodiment is mounted to a vehicle to enclose at least part of an area that a weapons or apparatus operator occupies. Embodiments of the invention have an upper portion which has protective overhead segments that can be locked and positioned such that an occupant of the protective structure have overhead protection as well as the ability to exit from the protective structure by positioning the segments to permit exit or entry from the top area of the protective structure. In certain illustrative embodiments, biasing devices are provided to bias segments toward open positions and thereby facilitate occupant egress. The structure may include a latching mechanism for at least two of the overhead protective segments which are adapted to withstand an impact from projectiles or fragments from bomb blasts. The protective structure has ballistic window placed around the structure, including the overhead protective segments which permit viewing through the windows and protection against expected projectiles or fragments.

BRIEF DESCRIPTION OF THE DRAWING

In the drawings, which are not necessarily to scale, like or corresponding parts are denoted by like or corresponding reference numerals.

DETAILED DESCRIPTION OF THE PREFERRED EMBODIMENTS

Figure 1:
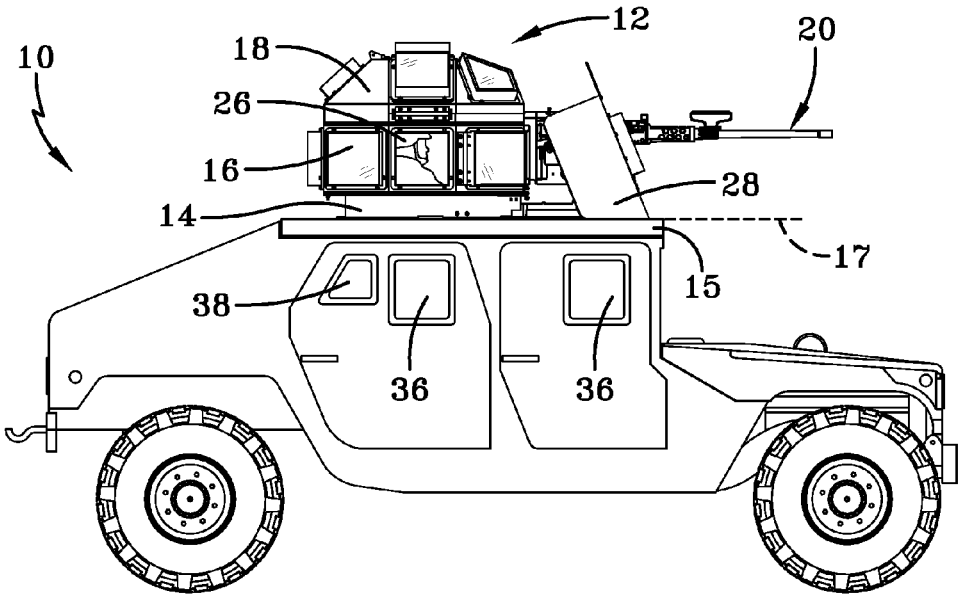
FIG. 1 is a side view of a vehicle with an embodiment of the invention mounted thereon.
Figure 2:
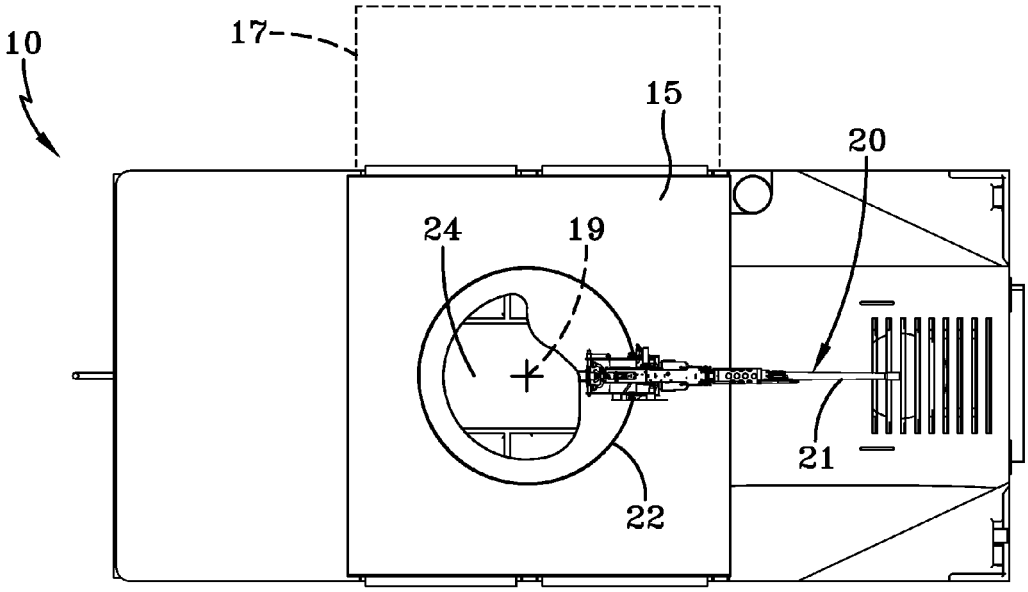
FIG. 2 is a top view of the vehicle of FIG. 1 without the an embodiment of the invention mounted thereon.

FIG. 1 is a side view of a vehicle 10 with one embodiment of a vehicle protective structure 12 mounted thereon. FIG. 2 is a top view of the vehicle 10 of FIG. 1 without the structure 12 mounted thereon. Structure 12 includes a first (lower) portion 14, a second (intermediate or wall) portion 16 and a third (upper) portion 18. The first portion 14 is fixed to a turret (traversal portion) 22 (FIG. 2) on an upper section 15 of the vehicle 10 and disposed around an opening 24 (FIG. 2). More particularly, the upper section 15 defines a plane 17 through which the opening 24 extends. The turret 22 is configured for rotation about a rotational axis 19 extending through the opening 24 substantially perpendicular to the plane 17. The second portion 16 is fixed to the first portion 14 and includes a plurality of windows disposed substantially vertically around the opening 24. As further detailed herein, the second portion 16 at least partially encloses a perimeter of a space extending generally above the opening 24.

Windows used in these embodiments of the invention are ballistic windows. Ballistic windows are components that are capable of stopping bullets or projectiles, including bomb or explosive fragments, fired at it and can be made of impact resistant materials including materials known as bullet-resistant glass or ballistic windows. The term "bullet" is meant to be used broadly in this case referring to ballistic or high velocity projectiles or weapons, including fragmentary devices and explosives or explosively formed projectiles, which are fired at or in the direction of the window(s) in question. Bullet-resistant glass is frequently constructed using a strong but transparent material such as polycarbonate thermoplastic or by using layers of laminated glass. One desired result is a material with an appearance and light-transmitting behavior of standard glass but offers varying degrees of protection from projectile weapons depending on the weight, configuration and weight requirements or limitations. A polycarbonate layer, including products such as Cyrolon®, Lexan® and Tuffak®, is sometimes sandwiched between layers of regular glass. The use of plastic in the laminate provides impact-resistance, such as physical assault with a hammer, an axe, etc. The plastic provides little in the way of bullet-resistance. The glass, which is much harder than plastic, flattens the bullet and thereby prevents penetration. Ballistic windows, ballistic glass, impact resistant glass or bullet-resistant glass can be 70-75 mm (2.8-3.0 in) thick, but could be more or less depending on the threat or weapons the windows are designed to defeat. Bullet-resistant glass includes glass constructed of laminated glass layers built from glass sheets bonded together with polyvinyl butyral or polyurethane. The glass can include one-way bullet-resistant glass as well as newer types of bullet-resistant glass or transparent materials such as aluminum oxynitride used as the outside "strike plate" layer.

The third portion 18 is fixed to the second portion 16 and extends upwardly and inwardly from the second portion 16 over the opening 24. The third portion 18 includes a plurality of windows. A shield 28 may be disposed in front of the first, second and third portions 14, 16, 18. In the case of armed conflict, foreign internal defensive operations or riot control engagements, structure 12 can protect a weapons operator or gunner 26 (FIG. 1) who operates a weapon, illustratively a gun 20 or other device such as a water cannon, high intensity laser or other anti-personnel or non-lethal personnel weapon system. The gunner or protective structure occupant 26 is located in the opening 24. However, structure 12 can protect individuals other than a gunner 26, for example, an observer. Structure 12 can also be used to protect or mount a sensor system or other items of equipment requiring protection and impact resistant windows standing alone or in combination with a weapons system or other anti-personnel or riot control system.

Figure 3:
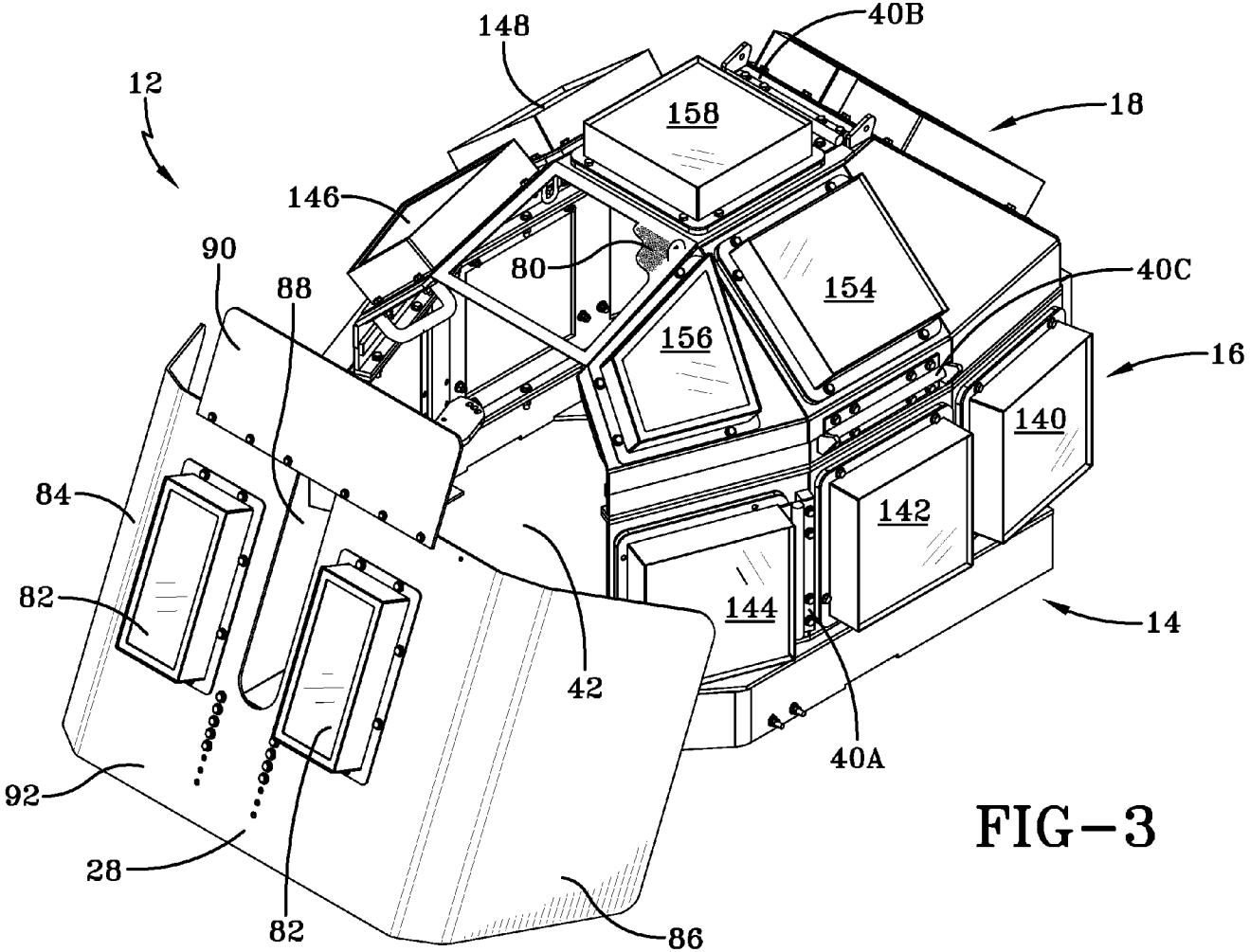
FIG. 3 is a perspective view of one embodiment of a vehicle protective structure.
Figure 4A:
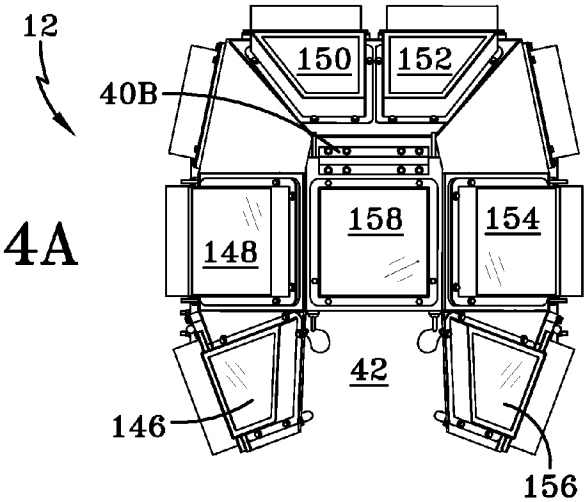
FIGS. 4A, 4B, 4C 4D and 4E are top, front, curb side, driver side and rear views, respectively, of the structure of FIG. 3, without the shield.

FIG. 3 is a perspective view of the vehicle protective structure 12 without the vehicle 10. FIGS. 4A, 4B, 4C 4D and 4E are top, front, curb side, driver side and rear views, respectively, of the structure 12 of FIG. 3, without the shield 28. As best seen in FIGS. 3 and 4A, the first, second and third portions 14, 16, 18 define a front opening 42. The gun 20 (FIG. 1) is disposed in the front opening 42 and the shield 28 (FIG. 3) is mounted adjacent the front opening 42.

In the embodiment shown in FIGS. 4A-4E, second portion 16 includes windows 130, 132, 134, 136, 138, 140, 142, 144. Window 130 is the front curb side window; window 132 is the second curb side window; window 134 is the rear curb side window; window 136 is the right rear window; window 138 is the left rear window; window 140 is the rear driver side window, window 142 is the second driver side window; and window 144 is the front driver side window.

The windows 130, 132, 134, 136, 138, 140, 142, 144 of the second portion 16 are substantially planar (not curved) and may be rectangular in shape. Second portion 16 may have eight windows as shown, but more or fewer windows may be used.

The eight windows 130, 132, 134, 136, 138, 140, 142, 144 may be the same size and, additionally, may be the same type of window (i.e., interchangeable) as the windows 36 in the doors of the vehicle 10 of FIG. 1. "Same type" of window means the windows have substantially the same size and shape and are interchangeable without any modifications. One or more of the windows 130, 132, 134, 136, 138, 140, 142 and 144 may be hinged. In FIGS. 4A-4E, the front driver side and curb side windows 144, 130 are shown mounted with hinges 40A to the second portion 16. Hinges 40A allow windows 144, 130 to rotate outward and rearward.

Third portion 18 may have seven windows 146, 148, 150, 152, 154, 156, 158 as shown, but more or fewer windows may be used. Window 146 is the front curb side window; window 148 is the rear curb side window; window 150 is the right rear window; window 152 is the left rear window; window 154 is the rear driver side window; window 156 is the front driver side window; and window 158 is the top window. Windows 146, 148, 150, 152, 154, 156 and 158 may be substantially planar.

The windows 148, 158, 154 may be the same type of window (i.e., interchangeable) as the windows 130, 132, 134, 136, 138, 140, 142, 144 of the second portion 16 and the windows 36 of the vehicle doors. Windows 148, 158 and 154 may be rectangular. Windows 146, 150, 152, 156 may be trapezoidal in shape and be the same type of window (i.e., interchangeable) as the window 38 in the door of vehicle 10 (FIG. 1). Top window 158 (FIG. 4A) may be mounted with a hinge 40B so that window 158 may rotate upwardly and rearwardly.

Front and rear driver side windows 156, 154 (FIG. 4C) may be mounted to the second portion 16 as a single unit using hinge 40C. Thus, front and rear driver side windows 156, 154 may rotate outwardly and downwardly as a single unit. Front and rear curb side windows 146, 148 (FIG. 4D) may be similarly mounted using a hinge 40C to thereby rotate outwardly and downwardly as a single unit. The front driver and curb side windows 156, 146 may be the same type of window as window 38 in the door of vehicle 10 (FIG. 1), that is, substantially trapezoidal. The rear driver and curb side windows 154, 148 may be the same type of window as window 36 in the door of vehicle 10 (FIG. 1), that is, substantially rectangular.

Third portion 18 may include right rear and left rear windows 150, 152. The two rear windows 150, 152 may be the same type of window as window 38 in the door of vehicle 10 (FIG. 1), that is, substantially trapezoidal.

Figure 5A:
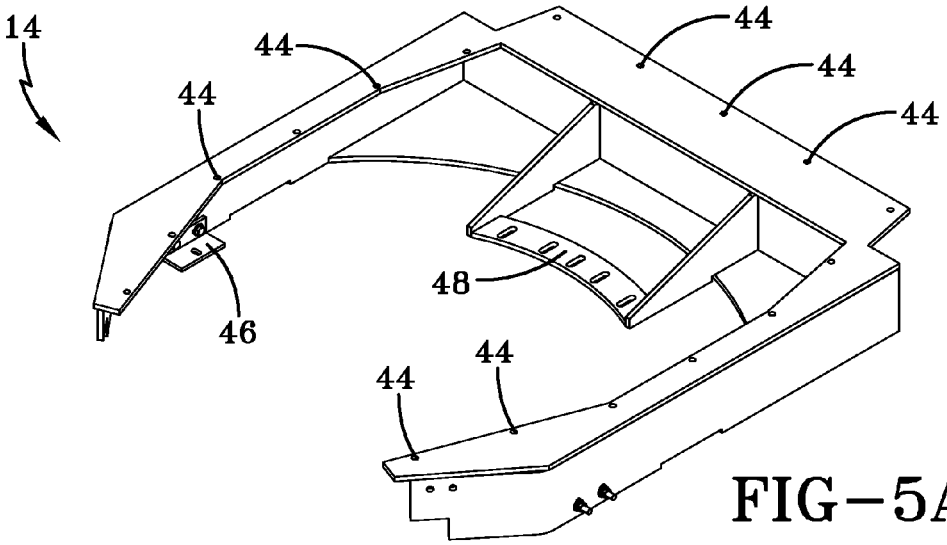
FIGS. 5A and 5B are perspective and top views, respectively, of an embodiment of a first portion of a vehicle protective structure.
Figure 5B:
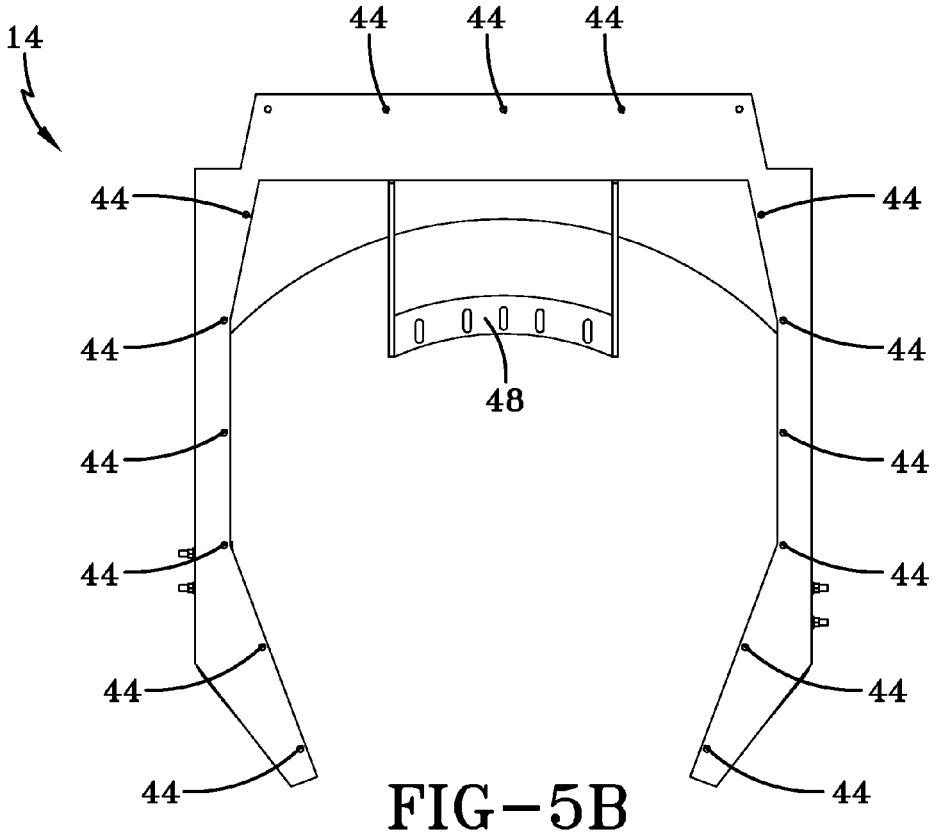

FIGS. 5A and 5B are perspective and top views, respectively, of one embodiment of a first portion 14 of the vehicle protective structure 12. The bolt holes 44 in the first portion 14 form a pattern that may be the same pattern as the bolt hole pattern in both the second portion 16 (FIG. 6B) and the third portion 18 (FIG. 8C). First portion 14 includes a pair of mounting brackets 46 and a rear bolt weldment 48 for fixing the first portion 14 to a vehicle, such as vehicle 10.

Figure 6A:
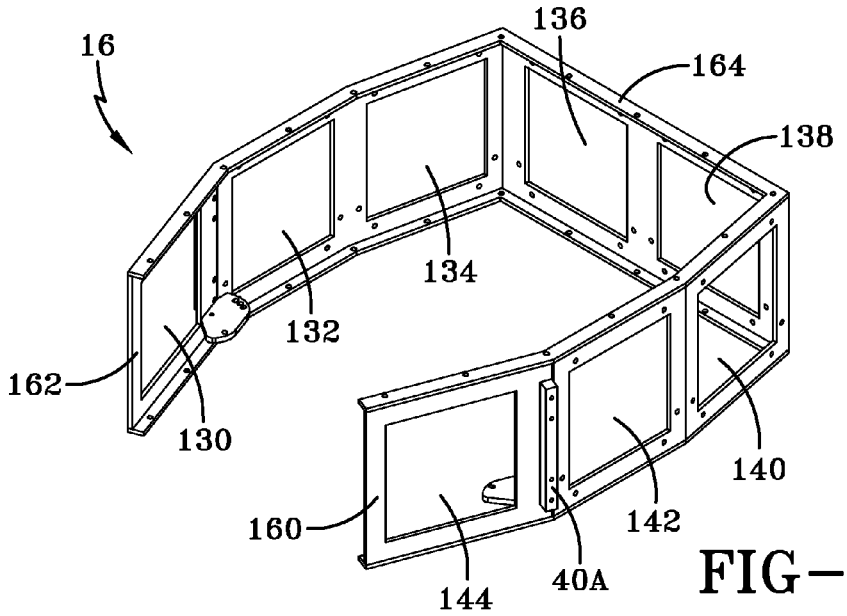
FIGS. 6A, B, C, D, E and F are perspective, top, sectional, curb side, rear and driver side views of an embodiment of a second portion of a vehicle protective structure.

FIGS. 6A, B, C, D, E and F are perspective, top, sectional, curb side, rear and driver side views of an embodiment of a second portion 16 of a vehicle protective structure 12. FIG.

Figure 6B:
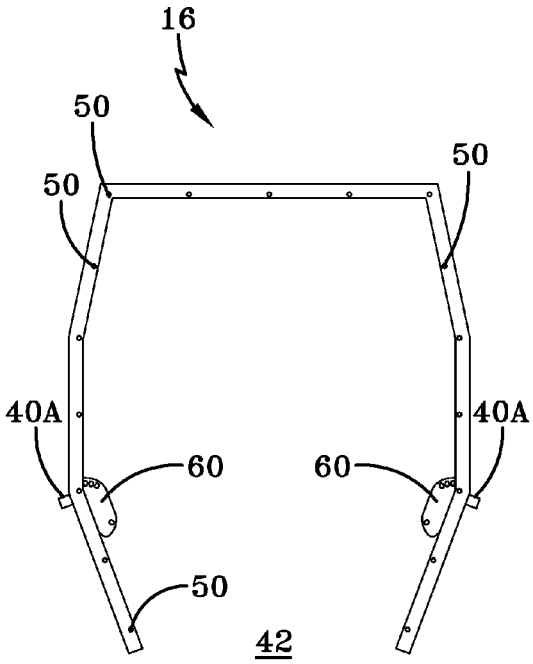
FIG. 6C is a sectional view along the line 6C-6C of FIG. 6E.
Figure 6C:
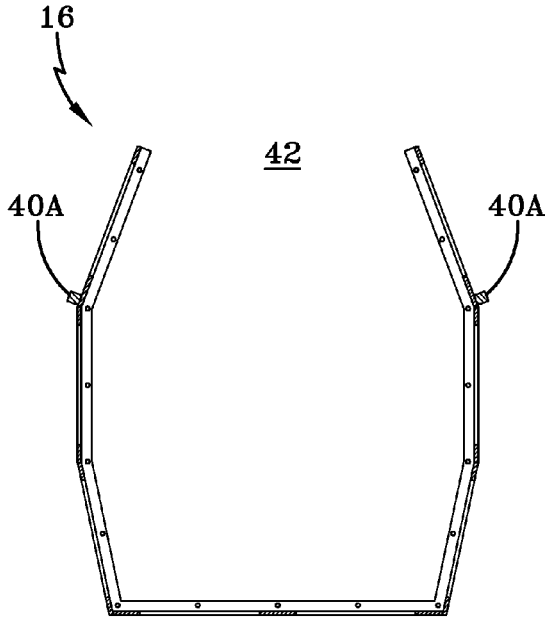
Figure 6D:
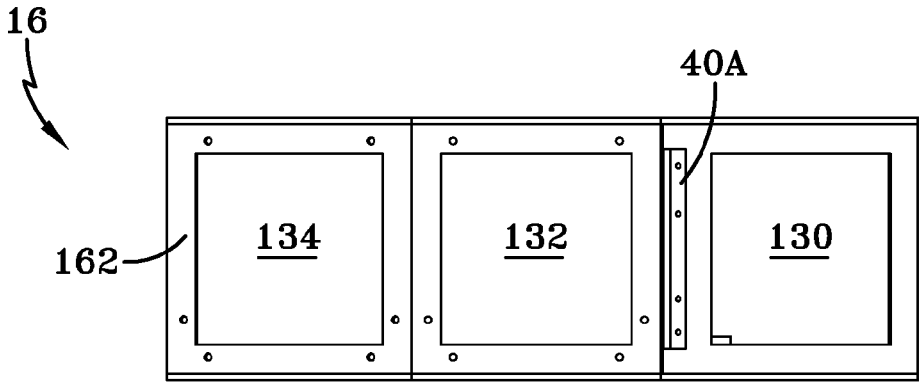
Figure 6E:
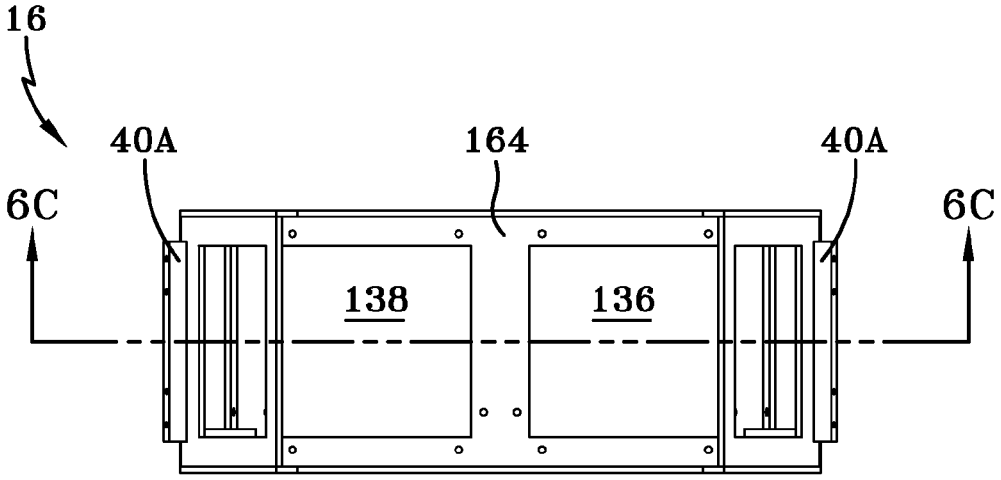

6C is a sectional view along the line 6C-6C of FIG. 6E. The windows 130, 132, 134, 136, 138, 140, 142, 144 of the second portion 16 are not shown in FIGS. 6A-6F. However, the window openings in second portion 16 for windows 130, 132, 134, 136, 138, 140, 142 and 144 are labeled with the corresponding window reference numeral for clarity.

Figure 6F:
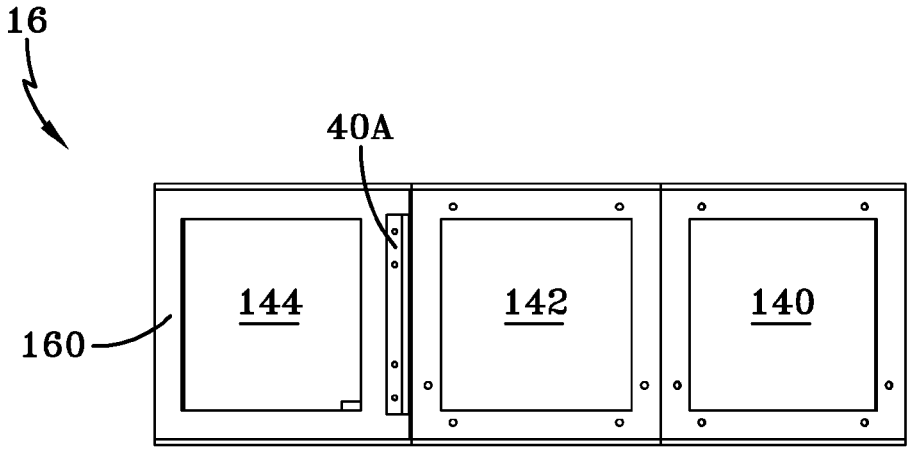

Referring to FIGS. 6A and 6F, the front driver side window 144, the second driver side window 142, and the rear driver side window 140 are mounted to a first side frame 160. Referring to FIGS. 6A and 6D, the front curb side window 130, the second curb side window 132, and the rear curb side window 134 are mounted to a second side frame 162. The rear windows 136 and 138 are mounted to an end frame 164, wherein the end frame 164 is connected between the first side frame 160 and the second side frame 162.

The gun 20 (FIG. 1) fits in front opening 42 (FIGS. 6A, B, C). Front opening 42 provides for about 60 degrees of horizontal gun rotation, that is, about 30 degrees each side of the center position. Thus, the first, second and third portions 14, 16, 18 provide about 300 degrees of protective to the gunner. The pattern of the bolt holes 50 (FIG. 6B) may be the same as the pattern of the bolt holes 44 in the first portion 14 (FIG. 5A) and the pattern of the bolt holes 52 in the third portion 18 (FIG. 8C).

Figure 7A:
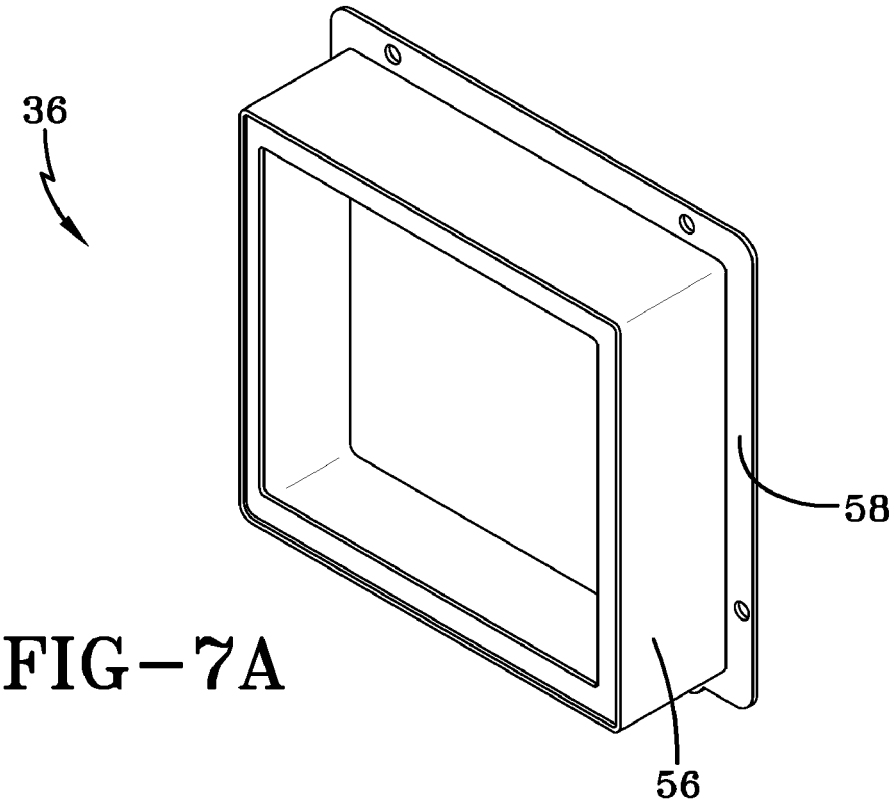
FIGS. 7A and 7B are perspective views of one type of ballistic windows.

FIG. 7A shows a rectangular ballistic window 36 (see also FIG. 1) that includes a frame 56 and a flange 58. Windows 36 may be used for windows 130, 132, 134, 136, 138, 140, 142, 144 of the second portion 16. Flange 58 may be bolted to second portion 16 so that each window is positioned in a corresponding window opening. The front driver side and front curb side windows 144, 130 (see also FIGS. 4D and 4C), rather than being bolted to the second portion 16, may be mounted on a hinge 40A. A manually operated opening and closing device 60 (FIG. 6B) (details not shown) may be provided for rotating the front driver side and front curb side windows 144, 130 outwardly. In certain embodiments, each opening and closing device 60 may include a latching device for securing the window 144, 130 in a desired (e.g., closed) position, and a biasing device for biasing the window 144, 130 toward an open position.

Figure 7B:
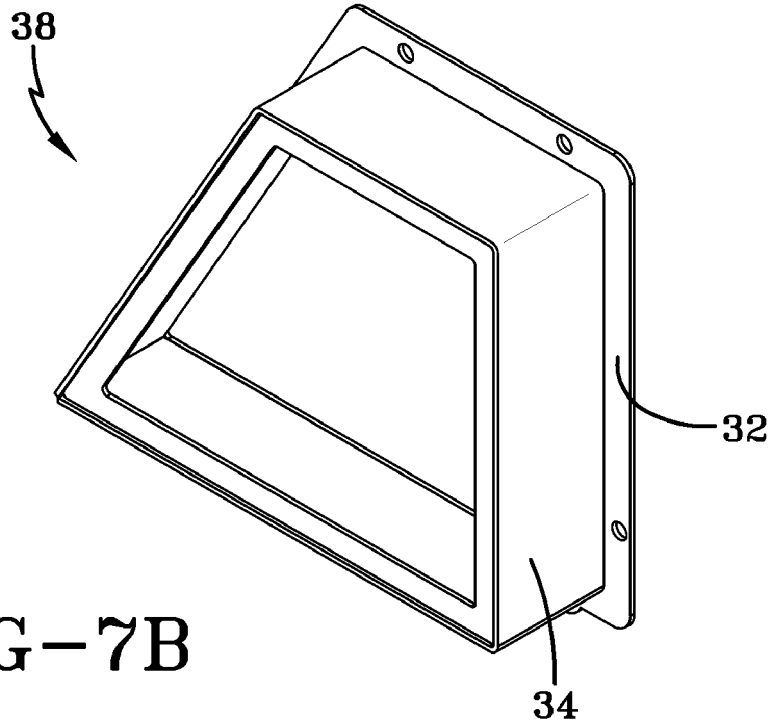
Figure 8A:
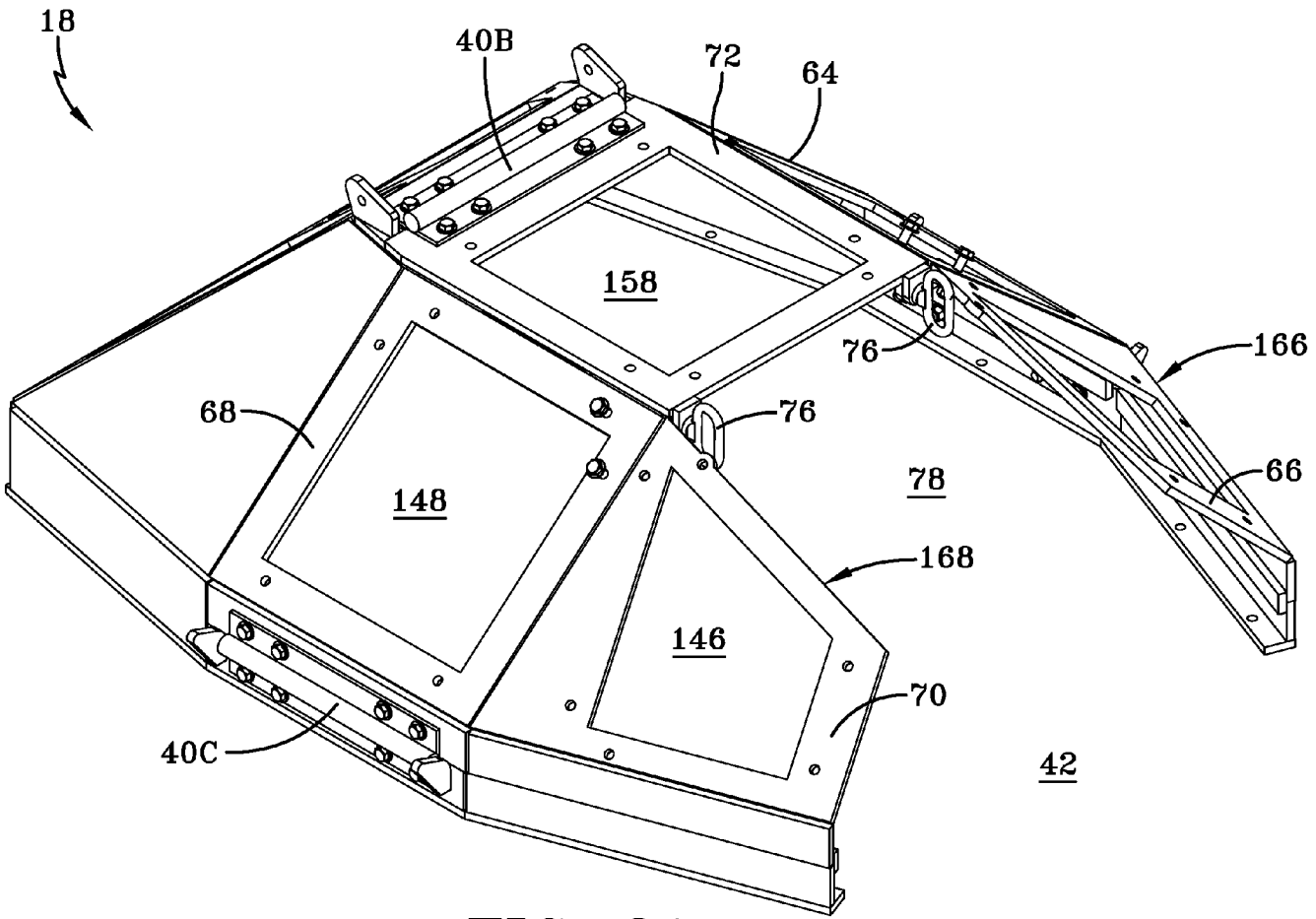
FIGS. 8A, B, C, D, E, F, and G are perspective, top, bottom, curb side, front, driver side, and rear views, respectively, of an embodiment of an third portion of a vehicle protective structure.
Figure 8C:
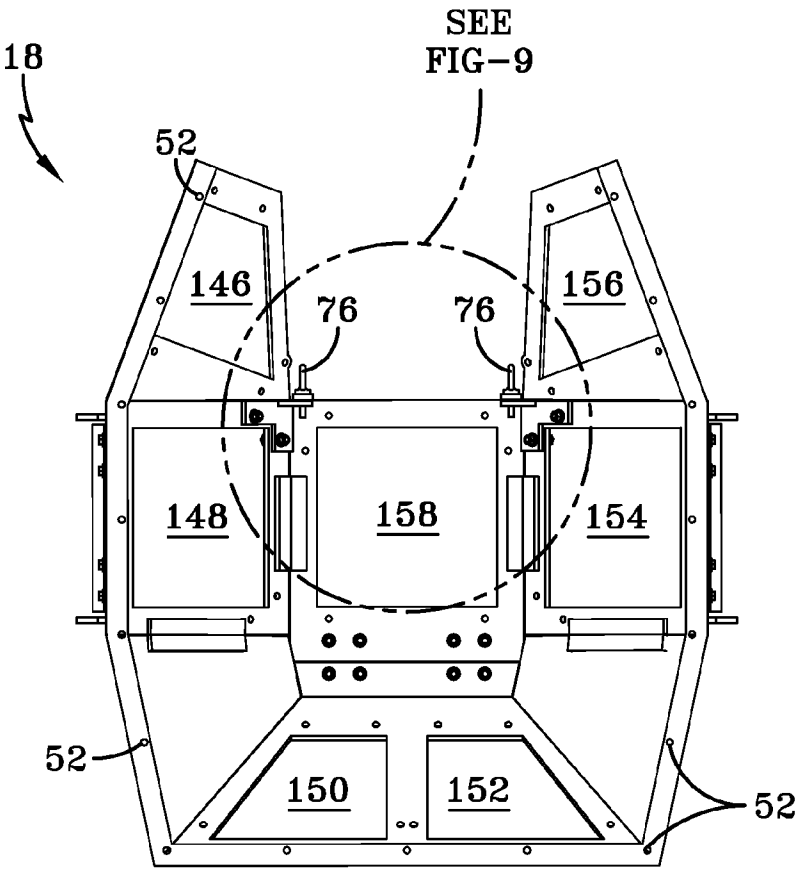

FIGS. 8A, B, C, D, E, F, and G are perspective, top, bottom, curb side, front, driver side, and rear views, respectively, of an embodiment of a third portion 18 of a vehicle protective structure 12. The windows 146, 148, 150, 152, 154, 156, 158 of the third portion 18 are not shown in FIGS. 8A-8G. However, the window openings in third portion 18 for windows 146, 148, 150, 152, 154, 156, 158 are labeled with the corresponding window reference numeral for clarity. Ballistic window 36 of FIG. 7A may be used for windows 148, 158, 154. FIG. 7B shows a ballistic window 38 (see also FIG. 1) having a frame 34 and a flange 32. Ballistic window 38 may be used for windows 150, 152, 156. Flange 32 may be bolted to third portion 18 so that each window is positioned in a corresponding window opening.

Figure 8B:
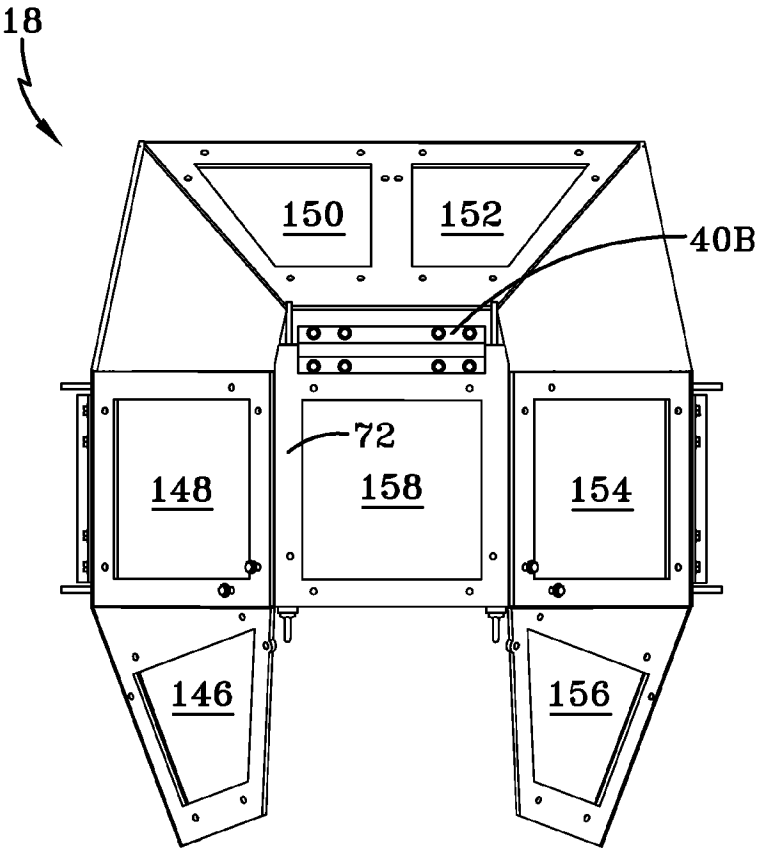
Figure 8E:
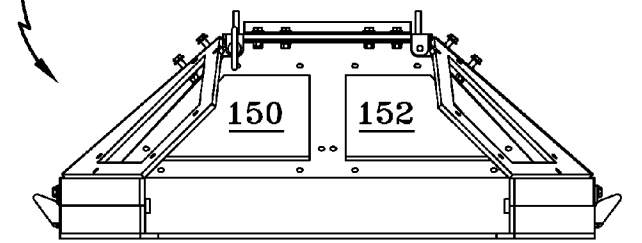
Figure 8G:
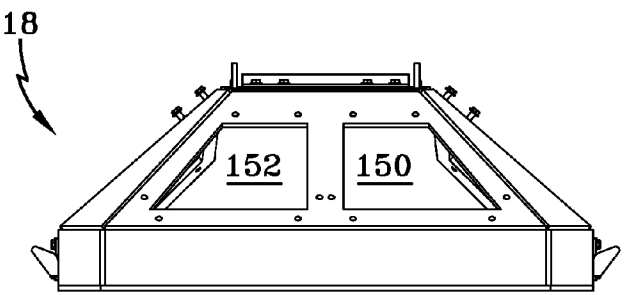
Figure 8D:
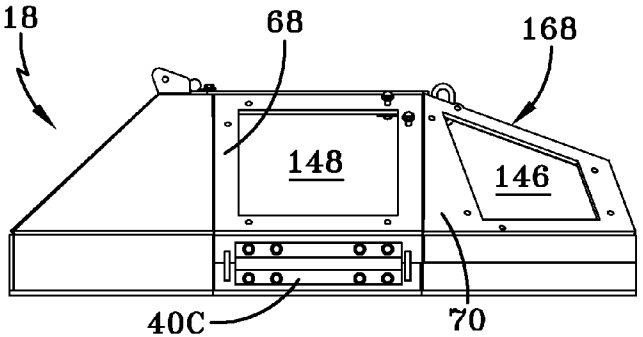
Figure 8F:
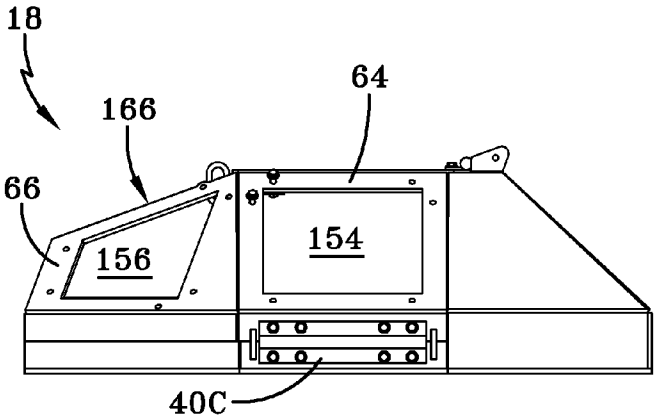

Referring to FIGS. 8F and 8D, the front and rear driver side windows 156, 154 and the front and rear curb side windows 146, 148 are fixed to respective frames 66, 64, 70, 68. Frame 64 is fixed to a hinge 40C, and frame 66 is fixed to frame 64 to define a first movable frame 166, such that windows 156, 154 may be rotated outwardly and downwardly as a single unit. Similarly, frame 68 is fixed to a hinge 40C, and frame 70 is fixed to frame 68 to define a second movable frame 168, such that windows 146, 148 may be rotated outwardly and downwardly. Movable frames 166 and 168 are slanted (extend upwardly and inwardly from the second portion 16) toward the opening 24 to reduce the potential for blockage by the vehicle during an accident (e.g., rollover). Additionally, movable frames 166 and 168 may each be operably coupled to a biasing device (e.g., spring) for biasing the frame 166, 168 toward an open position to facilitate quick egress by a vehicle occupant.

Figure 9:
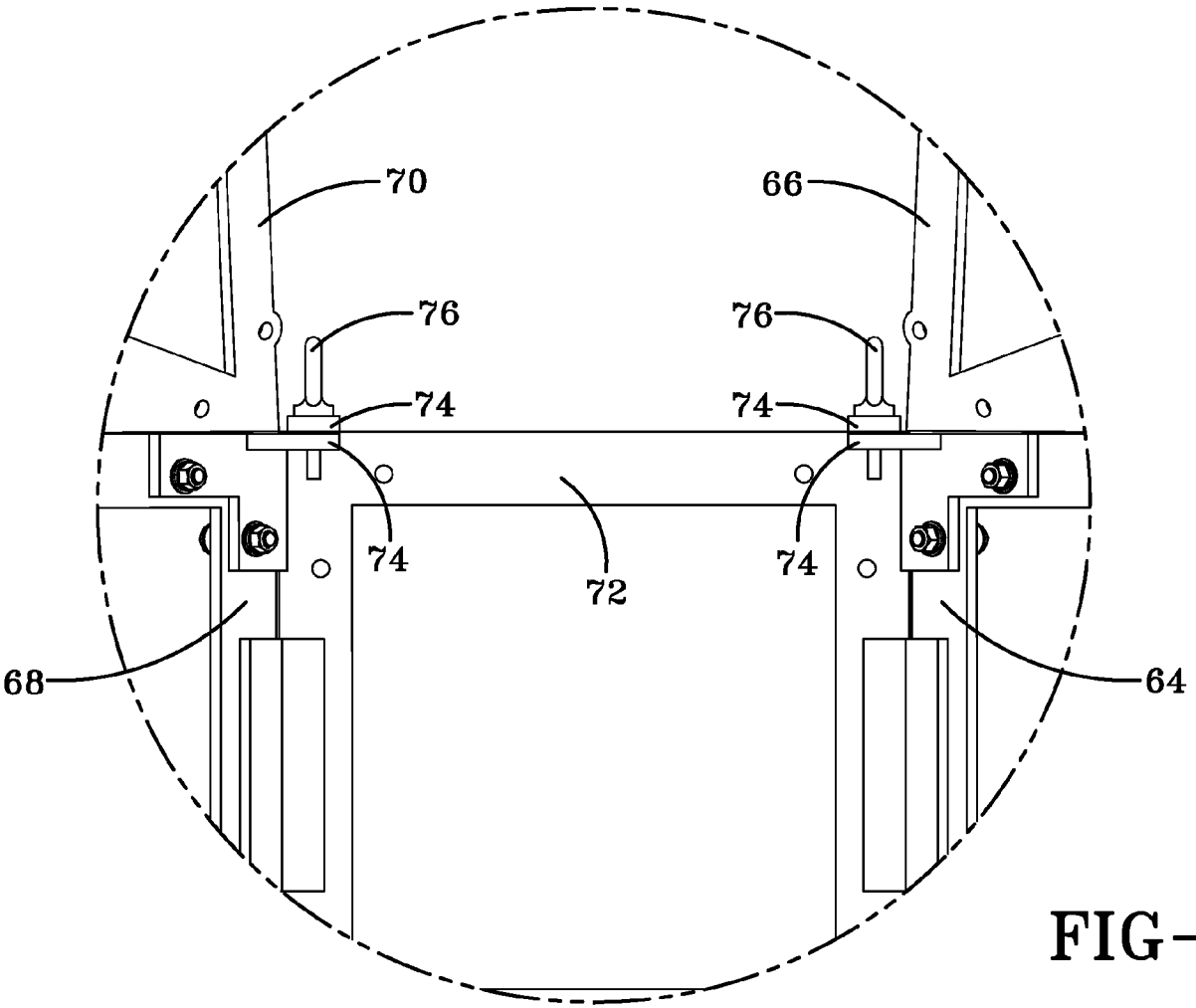
FIG. 9 is an enlarged view of a portion of FIG. 8C.

Referring to FIG. 8B, frame 72 for window 158 may be fixed to third portion 18 with a hinge 40 such that window 158 may be rotated upwardly and rearwardly. To secure top window 158, driver side windows 156, 154 and curb side windows 146, 148 in a closed position, flanges or bosses 74 (FIG. 9) are fixed to frames 72, 68 and 64. Frame 72 has two bosses 74 and frames 68, 64 have one boss each. Each boss 74 includes an opening therein for receiving a quick release pin 76. Thus, the opening in boss 74 of frame 68 is aligned with the opening in one of the bosses 74 of frame 72 and pin 76 is inserted therein. Similarly, the opening in boss 74 of frame 64 is aligned with the opening in the other of the bosses 74 of frame 72 and pin 76 is inserted therein. To rotate the top window 158 and the side windows 156, 154 and 146, 148, the quick release pins 76 are removed from the openings in the bosses 74. Pins 76 may be attached to lanyards to prevent misplacing them.

Figure 10B:
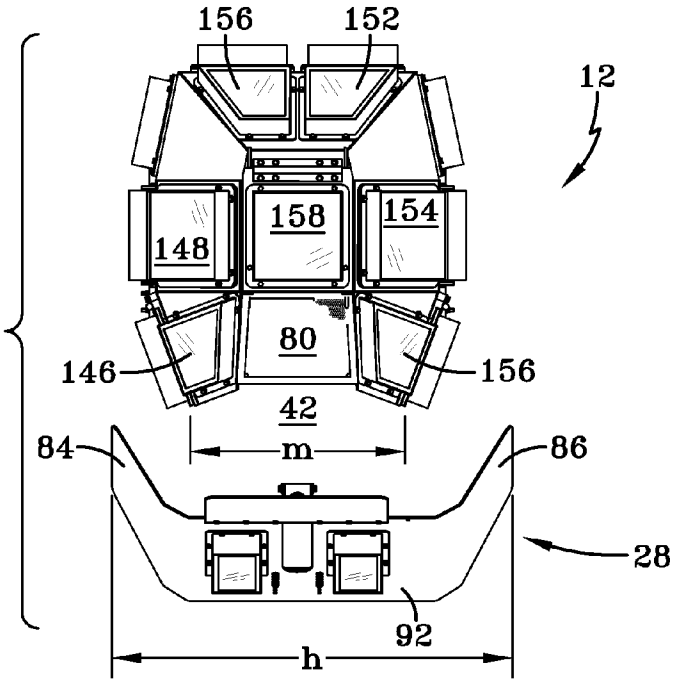
FIGS. 10A, 10B, and 10C are front, top and curb side views, respectively, of FIG. 3.

Referring to FIG. 8A, upper opening 78 in third portion 18 may be closed with an elastic net 80 shown in FIG. 10B.

Referring to FIG. 8C, the pattern of the bolt holes 52 (FIG. 8C) may be the same as the pattern of the bolt holes 44 in the first portion 14 (FIG. 5A) and the pattern of the bolt holes 50 in the second portion 16 (FIG. 6B). In one embodiment, the second portion 16 is fixed to the first portion 14 using threaded fasteners all having the same size head and the third portion 18 is fixed to the second portion 16 using threaded fasteners all having the same size head as the fasteners used to fix the second portion 16 to the first portion 14. In some embodiments of the invention, the second portion 16 is not used and the third portion 18 is fixed directly to the first portion 14. In other embodiments of the invention, the second portion 16 is fixed to the first portion 14 and the third portion 18 is not included.

Figure 4B:
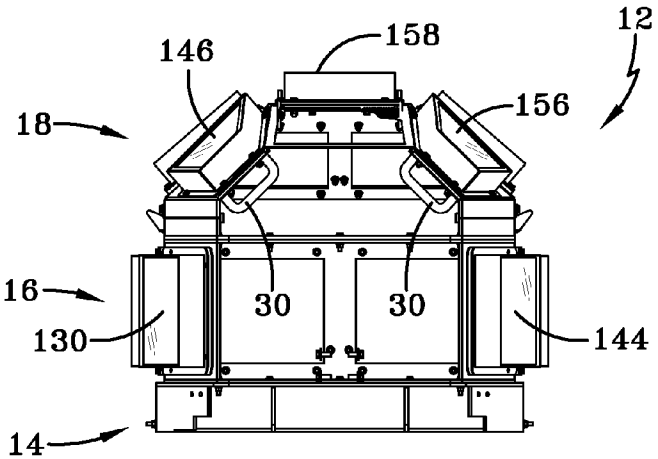
Figure 4C:
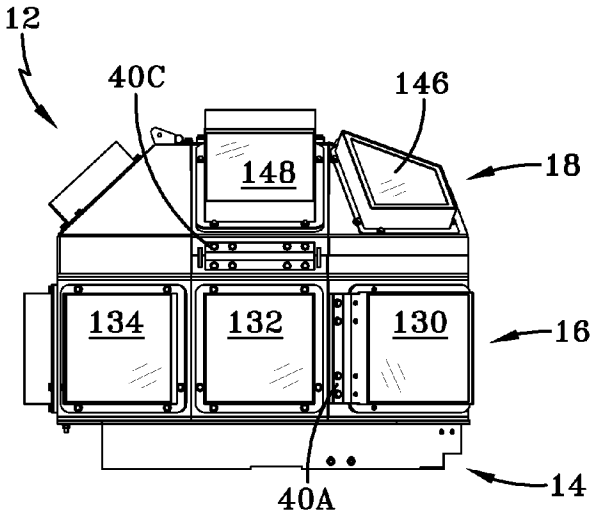
Figure 4E:
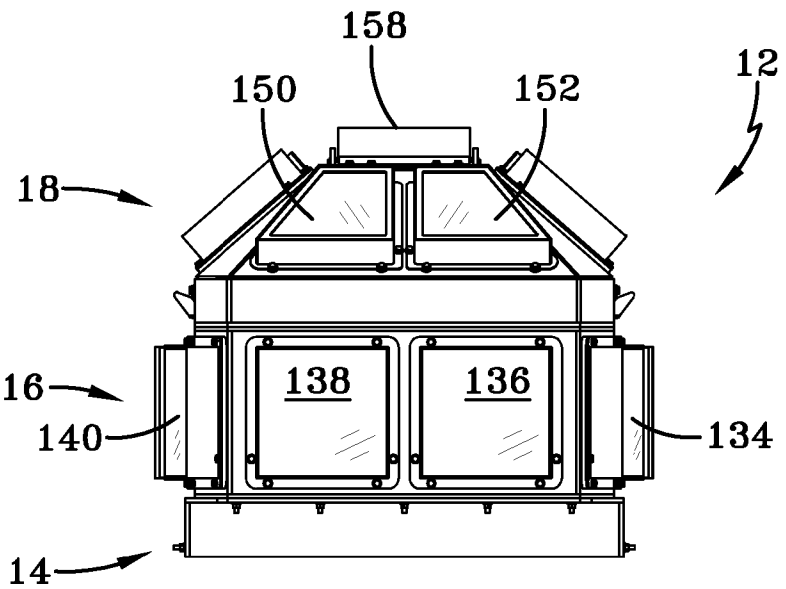
Figure 4D:
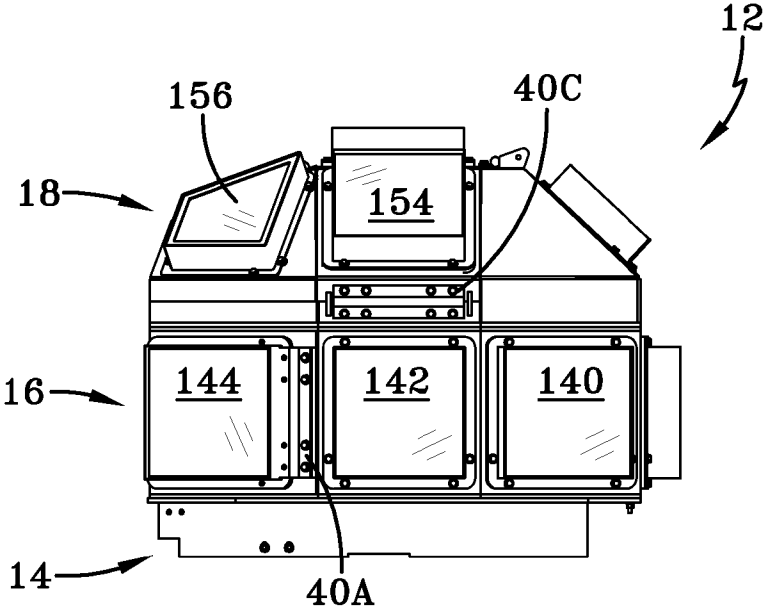

Third portion 18 may include one or more handles 30 (FIGS. 4A and 4B).

Figure 10A:
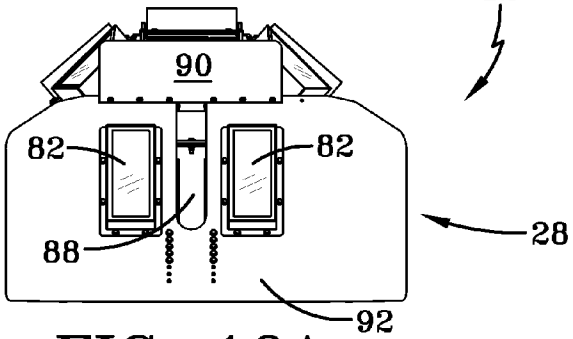
Figure 10C:
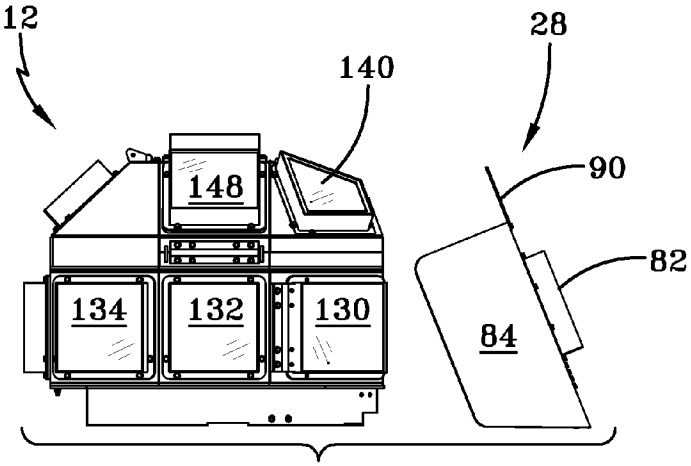

FIGS. 10A, 10B, and 10C are front, top and curb side views, respectively, of FIG. 3. Shield 28 may be fixed to a pintle (not shown) that is used to mount the gun 20 (FIG. 1). Shield 28 includes a front portion 92 and right and left side portions 84, 86 that extend rearwardly from the front portion 92. Front portion 92 includes at least one ballistic window 82 and an elongated opening or slot 88 for receiving the barrel 21 of gun 20 (FIG. 1). The transverse extent "h" (FIG. 10B) of the shield 28 is greater than the transverse extent "m" of the front opening 42. Front portion 92 may include a top plate 90 that extends above the opening 88.

Projectile resistant armor (e.g., steel) and ballistic glass may be used to fabricate vehicle protective structure 12.

Figure 11:
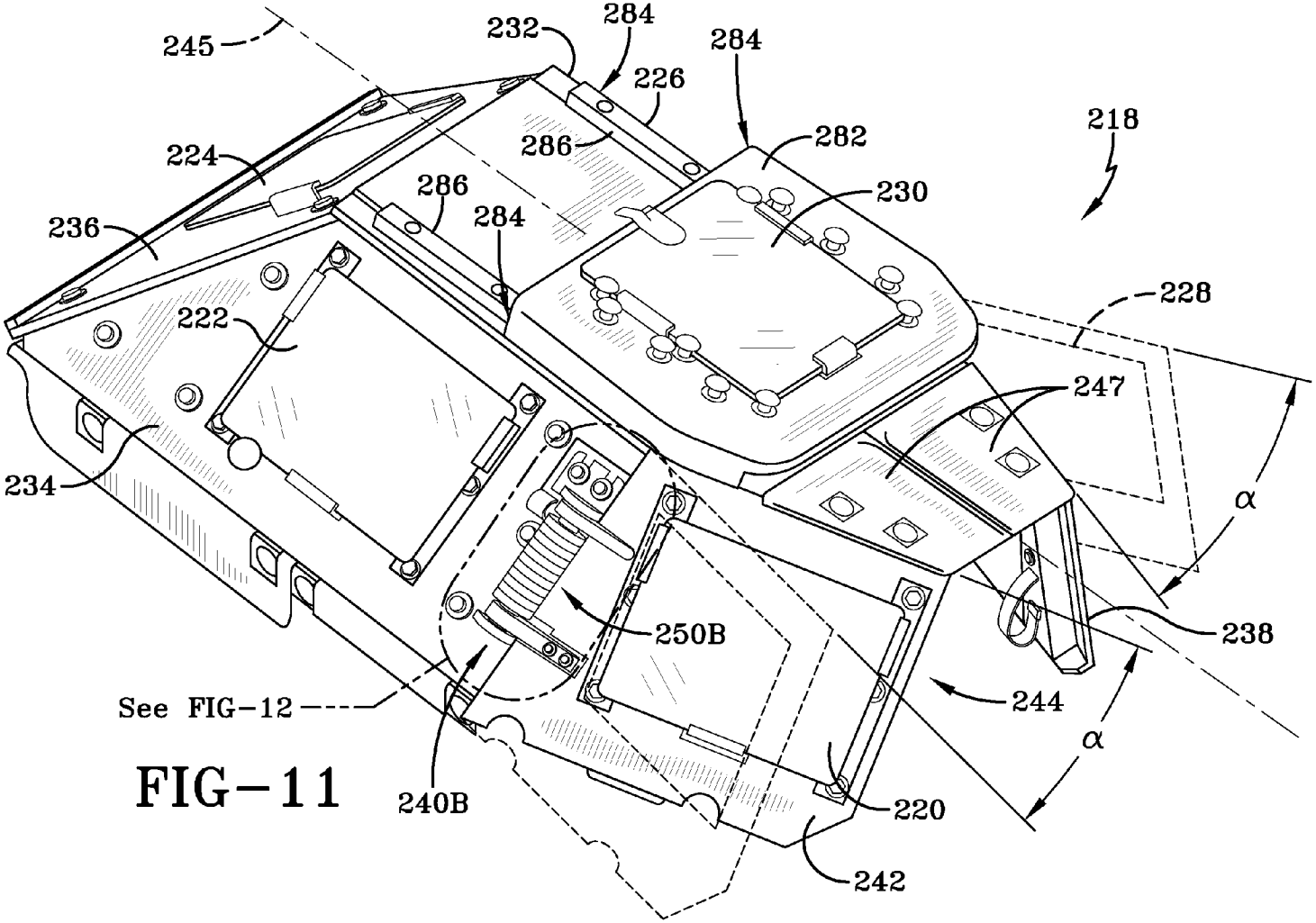
FIG. 11 is a perspective view of an illustrative third portion of a vehicle protective structure.

With reference to FIG. 11, a further illustrative third portion 218 is shown for use with vehicle 10. The third portion 218 may be operably coupled to the vehicle 10 with or without second portion 16 and/or first portion 14 in a manner similar to that detailed above with respect to third portion 18. A turret (traversal portion) 22 may be operably coupled to the third portion 218 to rotate the third portion 218 about the axis 19 of vehicle opening 24.

The third portion 218 illustratively includes a plurality of ballistic windows including a front curb side window 220, a rear curb side window 222, a rear window 224, a rear driver side window 226, a front driver side window 228, and a top window 230. Illustratively, the windows 220, 222, 224, 226, 228, and 230 are all substantially planar. Additionally, the windows 220, 222, 224, 226, 228, and 230 all illustratively have the ballistic characteristics of windows 146, 148, 150, 152, 154, 156, and 158 of third portion 18 as further detailed above.

The third portion 218 illustratively includes a first or driver side frame 232 configured to support the rear driver side window 226, and a second or curb side frame 234 configured to support the rear curb side window 222. An end frame 236 extends between the first and second side frames 232 and 234 and is configured to support the rear window 224. A first or driver side movable frame (door) 238 is pivotally coupled to the first side frame 232 through a hinge 240A. Similarly, a second or curb side movable frame (door) 242 is pivotably coupled to the second side frame 234 through a hinge 240B. A receiving space 244 is defined between the side frames 232 and 234 and extends along a longitudinal axis 245 above the vehicle opening 24.

The hinge 240A illustratively provides for pivoting movement of the first door 238 relative to the first side frame 232 (as shown by arc α in FIG. 11) between a closed position and a plurality of open positions. More particularly, the first door 238 is illustratively configured to move in a counterclockwise direction successively from the closed position (FIG. 13A) (inward from the first side frame 232 toward the longitudinal axis 245 of the receiving space 244), to a first open position (outward from the first side frame 232 away from longitudinal axis 245 of the receiving space 244), to a second open position, and to a third or fully open position. Similarly, the second door 242 is illustratively supported by the hinge 240B for pivoting movement relative to the second side frame 234 (as shown by arc α in FIG. 11) between a closed position and a plurality of open positions. More particularly, the second door 242 is illustratively supported for movement in a clockwise direction from the closed position (FIG. 13A) (inward from the second side frame toward the longitudinal axis 245 of the receiving space 244), to a first open position (FIG. 14A) (outward from the second side frame 232 away from the longitudinal axis 245 of the receiving space 244), to a second open position (FIG. 15A), and to a third or fully open position (FIG. 16A).

A protective cover 247 may be supported by an upper portion of each door 238 and 242. Each cover 247 is illustratively formed of armored plate and meets along a vertical plane parallel to the axis 245.

Figure 12:
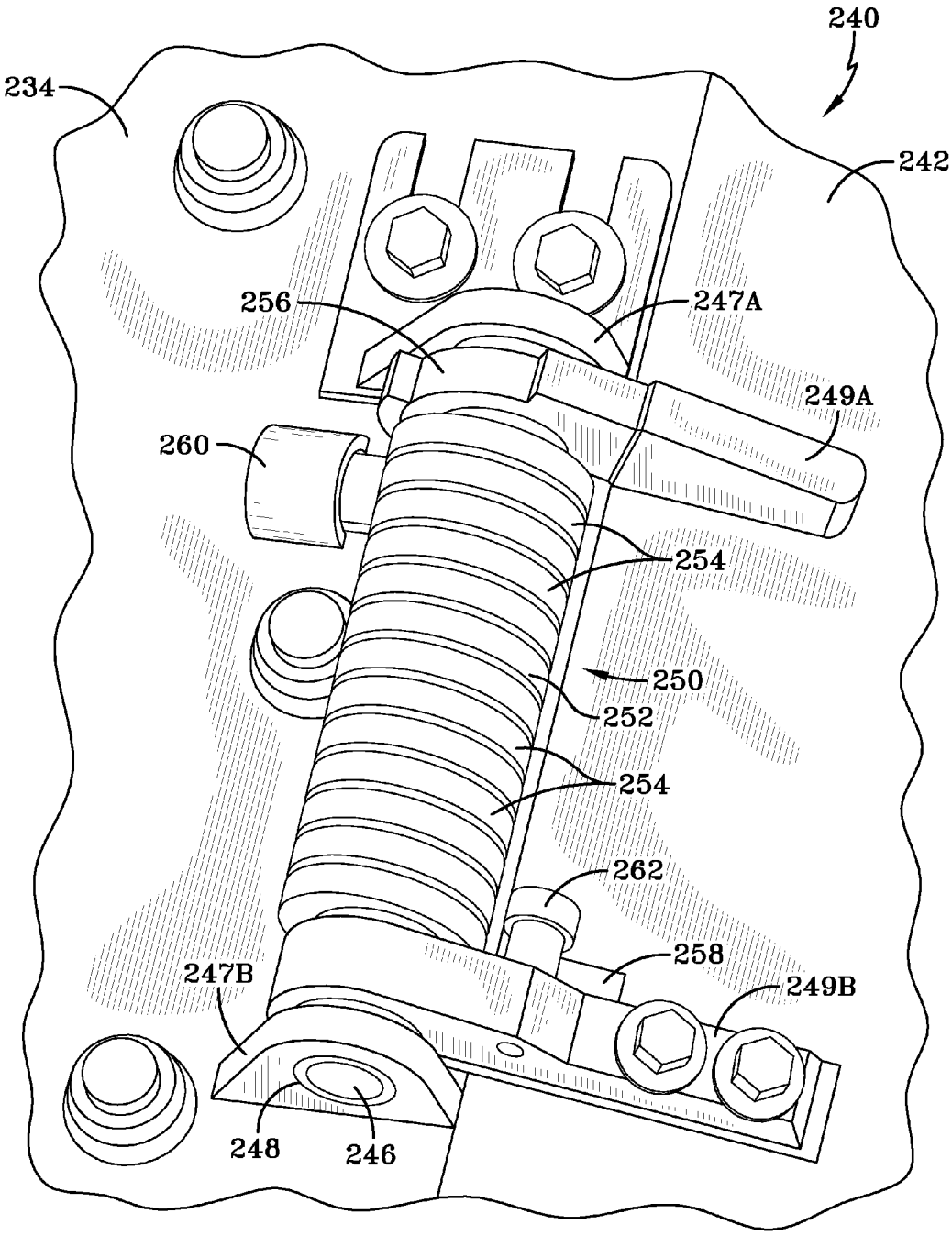
FIG. 12 is an enlarged view of a portion of FIG. 11, showing an illustrative biasing device.

With reference to FIG. 12, each hinge 240 illustratively includes a pivot pin or rod 246 supported for rotation between upper and lower supports or bosses 247A and 247B. Each boss 247 is secured to respective frame 232, 234 and may support a bearing 248 receiving the pivot rod 246. Swing arms 249A, 249B couple upper and lower portions of the pivot rod 246 to respective door 238, 242.

A first biasing device 250A is operably coupled to the hinge 240A of the first door 238 and is configured to bias the first door 238 from the closed position toward the first open position. Similarly, a second biasing device 250B is operably coupled to the hinge 240B of the second door 242 and is configured to bias the second door 242 from the closed position toward the first open position. With further reference to FIG. 12, each biasing device 250 illustratively comprises a torsion spring 252 received over the pivot rod 246 of respective hinge 240, and operably coupled intermediate the door 238, 242 and respective frame 232, 234.

The torsion spring 252 is configured to operate in different modes depending upon the relative position of the door 238, 242 relative to the side frame 232, 234. While reference in the following description may be directed to the second door 242 and associated biasing device 250B, it should be understood that the first door 238 and associated biasing device 250A operate in a similar manner (except for pivoting in an opposite direction (i.e., counterclockwise direction as opposed to clockwise direction from the closed position)).

With further reference to FIG. 12, the torsion spring 252 illustratively includes a plurality of active coils 254 extending between retaining tabs 256 and 258 supported at opposing ends. The upper tab 256 is received within a retainer 260 coupled to frame 232, 234, while the lower tab 258 is coupled to respective door 238, 242 by a fastener 262 received within swing arm 249B. The fastener 262 and/or swing arm 249B may be removed to facilitate replacement of the spring 252.

The torsion spring 252 is designed to permit the door 238, 242 to open automatically (i.e., "pop open"), even when the vehicle 10 is supported on its opposing side. In other words, the torque generated by the spring 252 is sufficient to move the door 238, 242, without manual force being applied by the operator, from its closed position to its first open position. In the illustrated embodiment, the spring 252 is configured to provide a spring torque having a value of "+A," wherein "+A" is equal to 900 lb.-in. when the door 238, 242 is in the closed position.

Figure 13B:
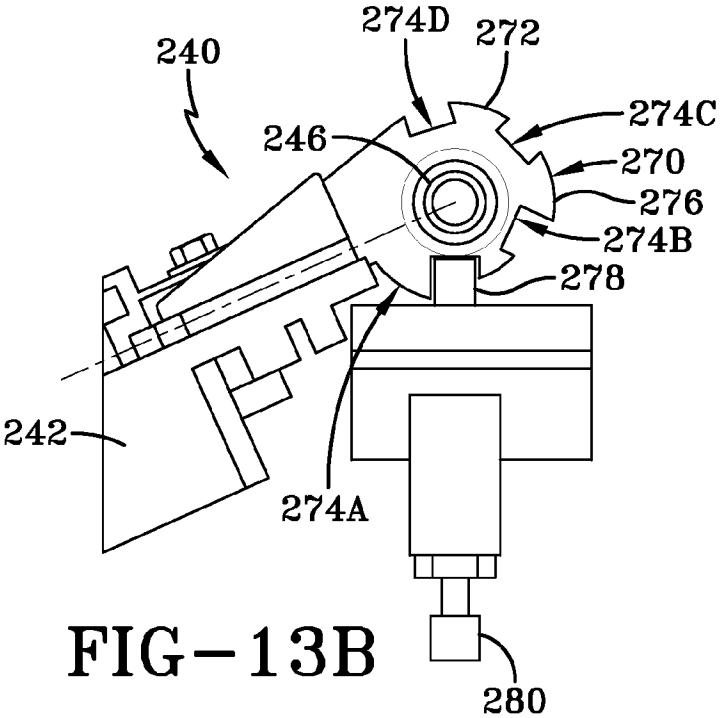
FIG. 13B is an enlarged view of a portion of FIG. 13A, showing details of the door locking device.
Figure 13A:
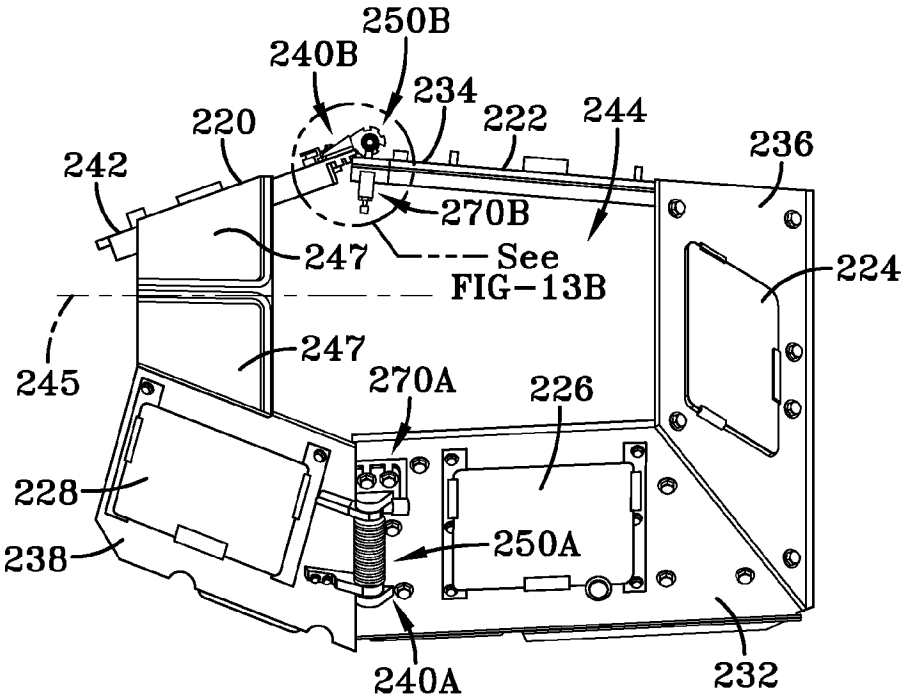
FIG. 13A is a top perspective view, in partial section, of the third portion of FIG. 11, showing the driver side and curb side doors in closed positions.

With reference to FIGS. 13A and 13B, a first door locking device 270A is operably coupled to the first door 238 and is configured to secure the first door 238 in a selected one of the closed, first open, second open, and third open positions. Similarly, a second door locking device 270B is operably coupled to the second door 242 and is configured to selectively secure the second door 242 in a selected one of the plurality of positions. Illustratively, each door locking device 270 comprises a rotatable index member 272 operably coupled to the door 238, 242 and configured to rotate about the pivot rod 246 of hinge 240. A plurality of circumferentially spaced recesses 274A, 274B, 274C, 274D are formed within the outer periphery 276 of the index member 272 and are associated with the rotational positions of the door 238, 242. A pin 278 is configured to be releasably received within a selected one of the recesses 274 of the index member 272 to lock the door 238, 242 in the desired position. The pin 278 may be spring biased toward the index member 272 and released by the operation of a pull handle 280.

In certain illustrative embodiments, the pull handle 280 may require combined twisting and pulling motions to release the pin 278. In certain other illustrative embodiments, an explosive may be used to forcibly uncouple the pin 278 (e.g., through fragmentation of the pin 278), in the case of emergency egress. Fragmentation of the pin 278 helps prevent potential jamming of the locking device 270 and door 238, 242 in a closed position due to vehicle impact.

With reference now to FIGS. 13A-17, operation of the doors 238, 242 will be further detailed. While in the following description the operation of the second door 242 will be used for illustrative purposes, it should be appreciated that the first door 238 operates in a similar manner (except for pivoting in an opposite direction (i.e., counterclockwise direction as opposed to clockwise direction from the closed position)).

Figure 17:
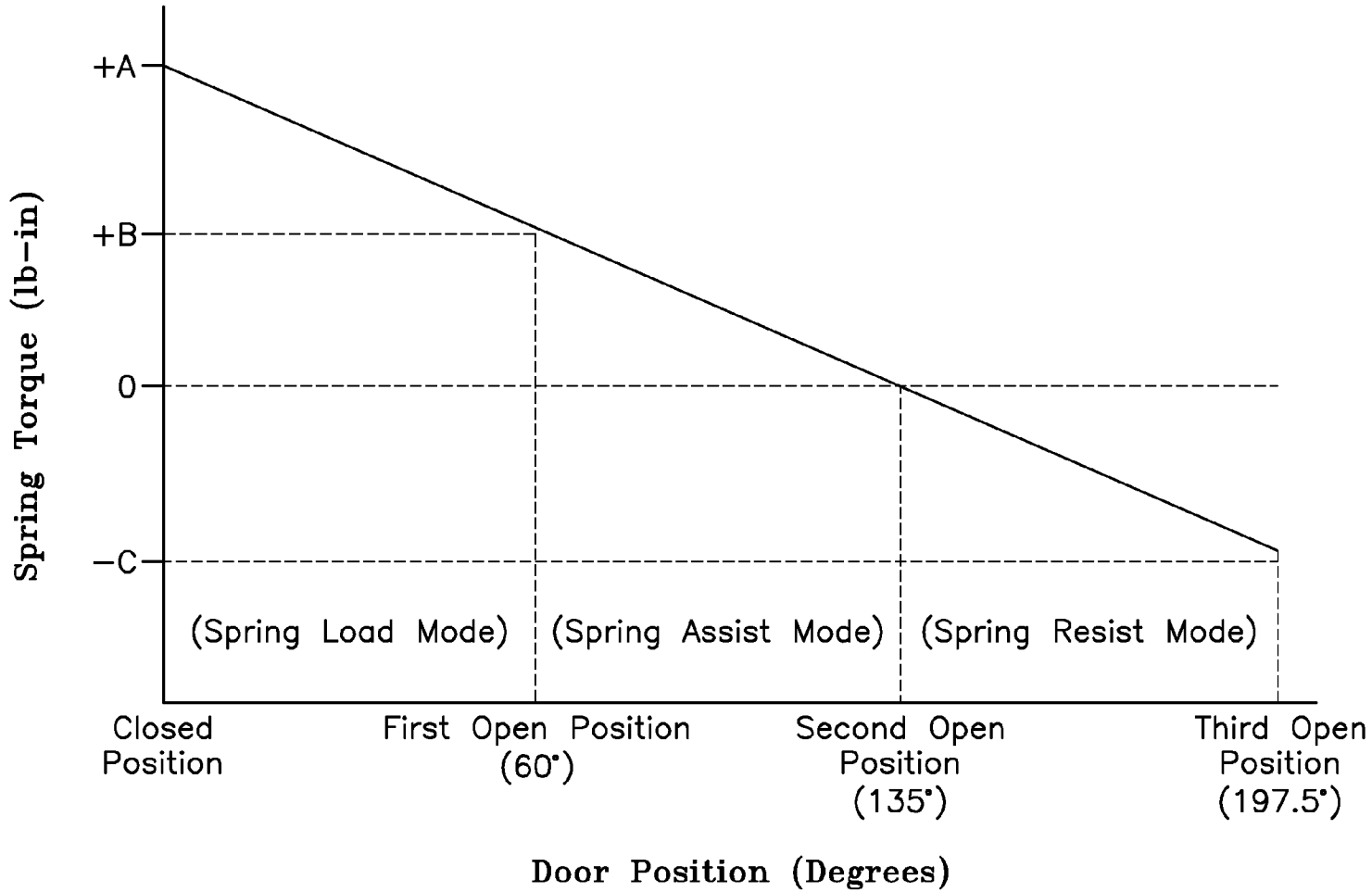
FIG. 17 is a diagram illustrating spring torque as a function of door displacement.
Figure 18:
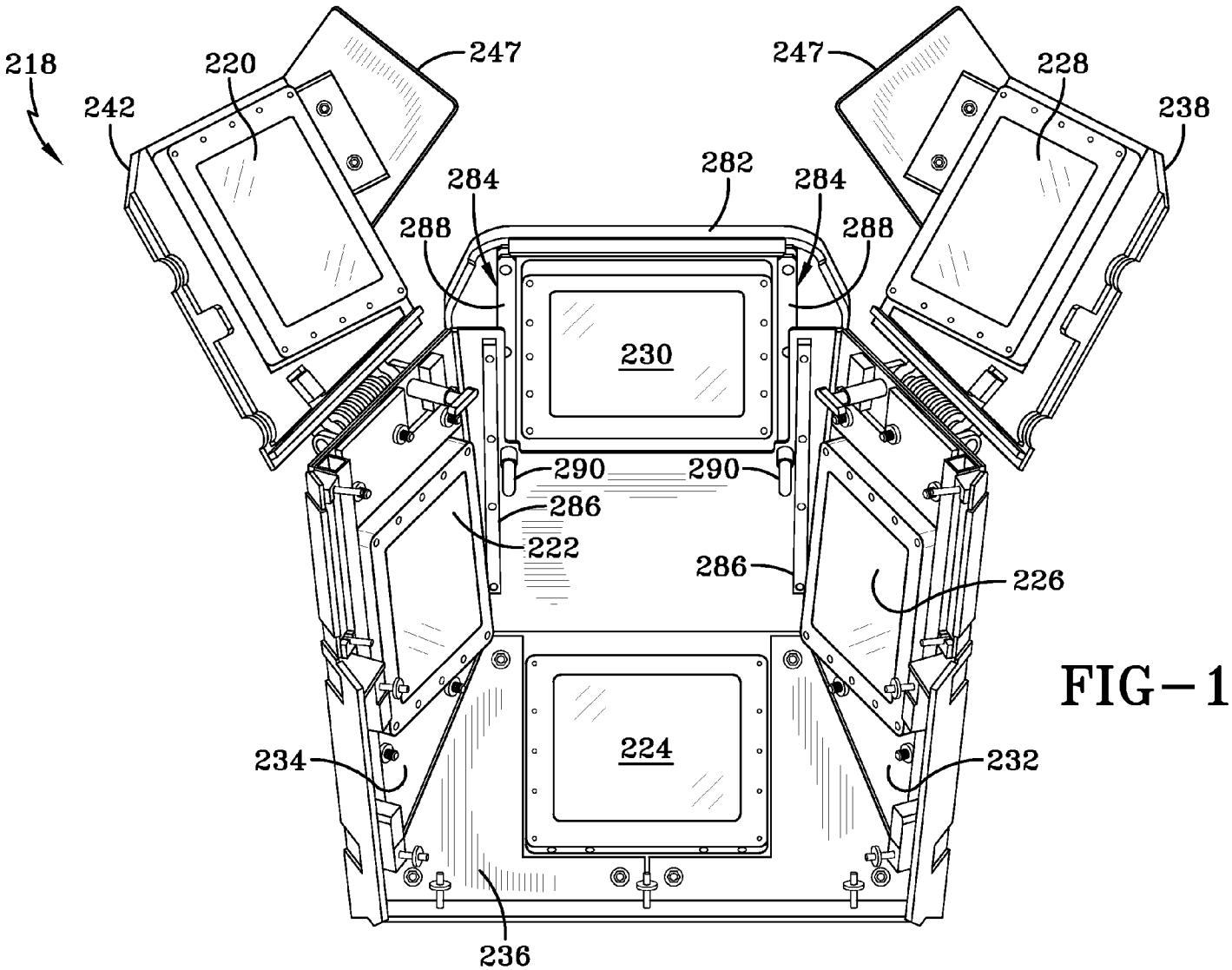
FIG. 18 is a bottom perspective view of the third portion of FIG. 11, showing the movable top frame in a closed position.

In FIGS. 13A and 13B, the curb side door 242 is shown in a closed position. In this position, the pin 278 of locking device 270B is secured within a first recess 274A of index member 272 to prevent movement of the door 242. The dimensions and relative positioning of the pin 278 within the recess 274A is configured to prevent inadvertent or undesired opening of the door 242 due to an impact or an explosive blast. As illustrated in FIG. 17, the torsion spring 252 of the biasing device 250B in the closed position provides a clockwise torque (having a value of "+A" due to the deflection of the torsion spring 252 in a counter-clockwise direction from its relaxed position (illustratively 135 degrees from the second open position as further detailed herein). Upon releasing the pin 278 of the locking device 270, the "+A" torque provided by the torsion spring 252 will cause the door 242 to swing open without further operator assistance. As such, a spring load mode is defined intermediate the closed position of FIGS. 13A and 13B and the first open position of FIGS. 14A and 14B.

Figure 14B:
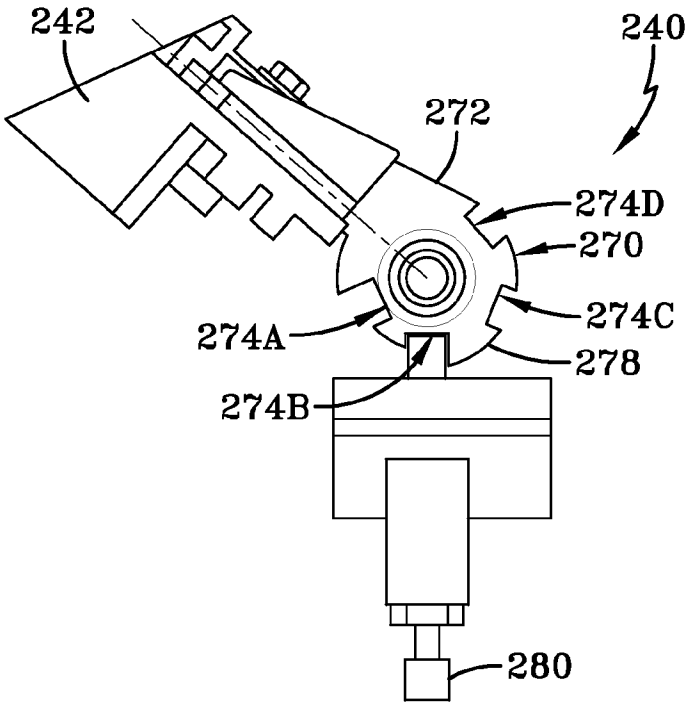
FIG. 14B is an enlarged view of a portion of FIG. 14A, showing details of the door locking device.
Figure 14A:
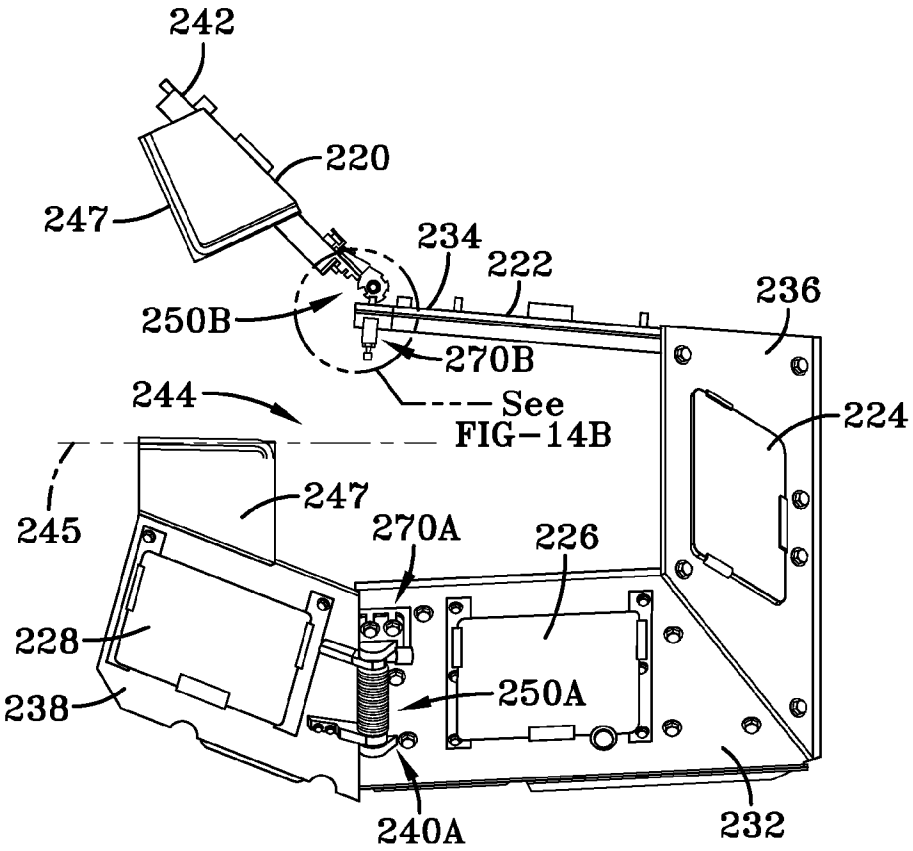
FIG. 14A is a top perspective view, in partial section, of the third portion similar to FIG. 13A, showing the curb side door in a first open position.

With reference to FIGS. 14A and 14B, the curb side door 242 is shown in a first open position, illustratively 60° counter-clockwise from the closed position. In this position, the pin 278 of locking device 270B is secured within a second recess 274B of the index member 272 to prevent movement of the door 242. As shown in FIG. 17, the torsion spring 252 of the biasing device 250B in the first open position provides a reduced clockwise torque (having a value of "+B") compared to that in the closed position. More particularly, intermediate the first open position and the second open position of the door 242, the spring 252 defines a spring assist mode. In the spring assist mode, the spring 252 provides torque to assist the operator in moving the door 242, but not sufficient torque to move the door 242 without additional external force from the operator.

Figure 15B:
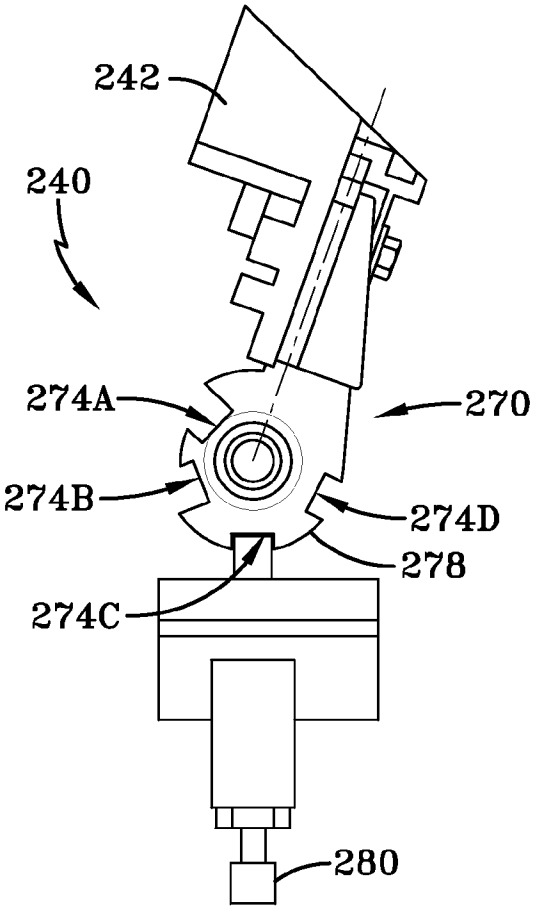
FIG. 15B is an enlarged view of a portion of FIG. 15A, showing details of the door locking device.
Figure 15A:
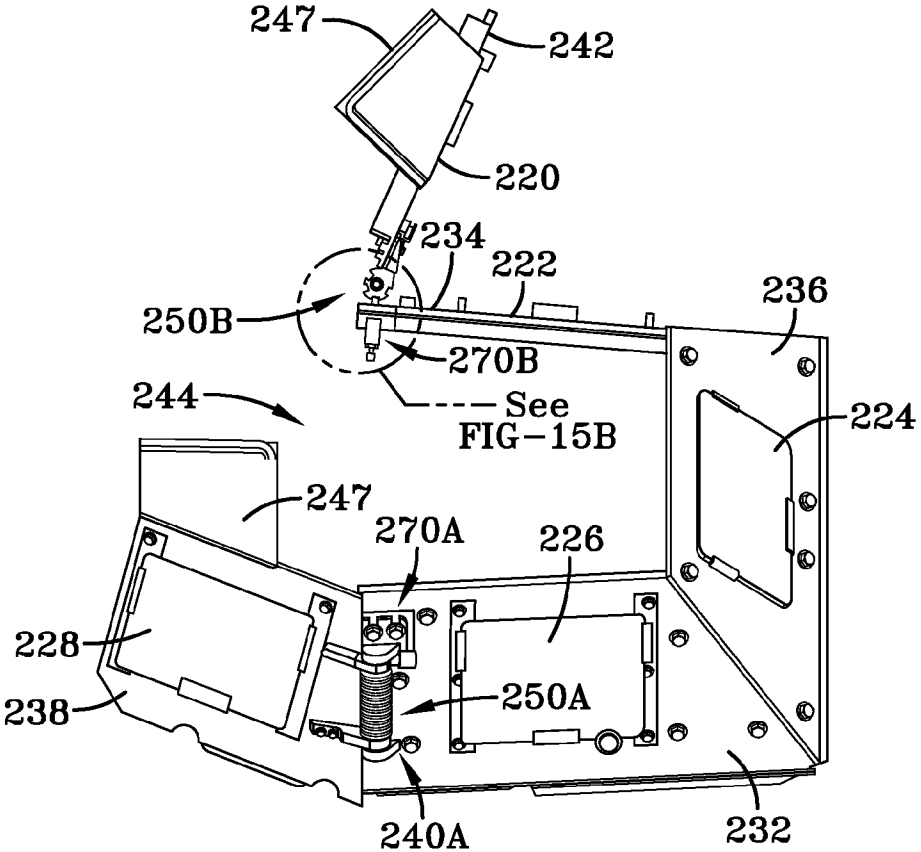
FIG. 15A is a top perspective view, in partial section, of the third portion similar to FIG. 13A, showing the curb side door in a second open position.

FIGS. 15A and 15B illustrate the curb side door 242 in a second open position, illustratively 135° counter-clockwise from the closed position. In this position, the pin 278 of locking device 270B is secured within a third recess 274C of the index member 272 to prevent movement of the door 242. As illustrated in FIG. 17, the torsion spring 252 of the biasing device 250B in the second open position is in a relaxed state (i.e., provides no torque to the door 242).

Figure 16B:
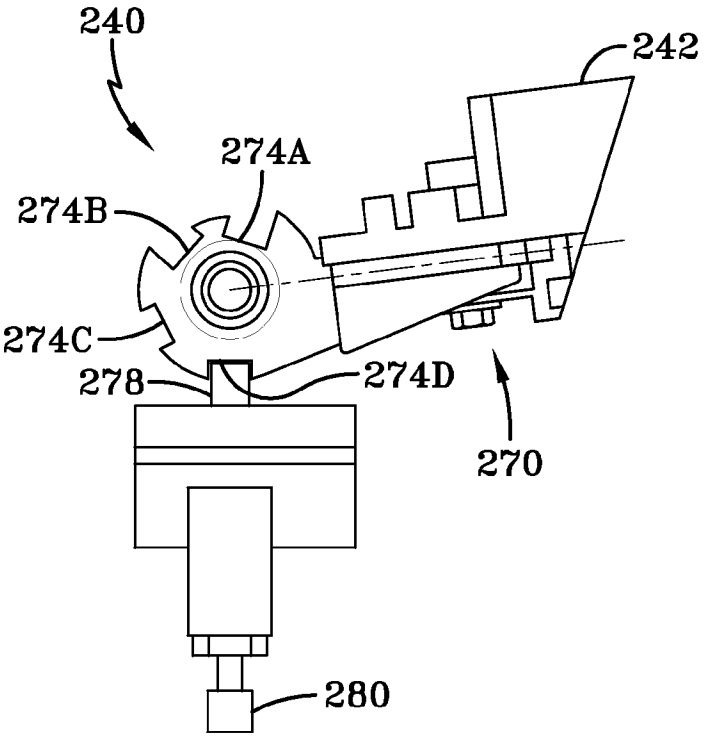
FIG. 16B is an enlarged view of a portion of FIG. 16A, showing details of the door locking device.
Figure 16A:
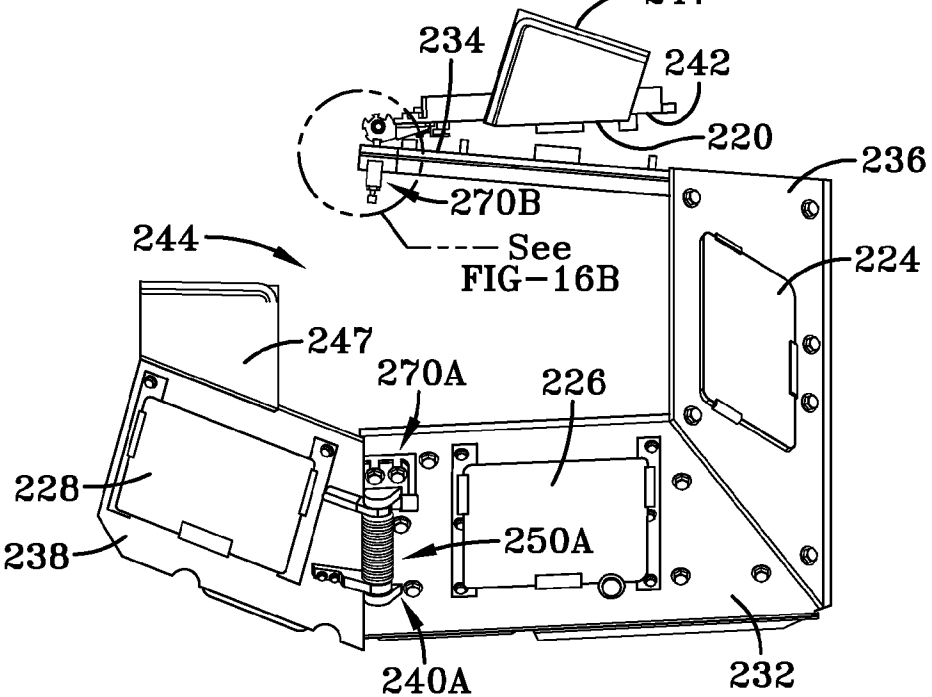
FIG. 16A is a top perspective view, in partial section, of the third portion similar to FIG. 13A, showing the curb side door in a third or fully open position.

FIGS. 16A and 16B illustrate a third or fully open position. In this position, the pin 278 of locking device 270B is secured within a fourth recess 274D of the index member 272 to prevent movement of the door 242. As shown in FIG. 17, the torsion spring 252 of the biasing device 250B in the third open position provides a reduced counter-clockwise torque (having a value of "−C") compared to that in the closed position. More particularly, intermediate the second open position and the third open position of the door 242, the spring 252 defines a spring resist mode. In the spring resist mode, the spring 252 provides counter-clockwise torque to resist the operator from moving the door 242 in a clockwise direction from the second open position toward the third open position.

FIGS. 11 and 17 illustrate a top frame 282 supporting the top window 230. The top frame 282 is supported for sliding movement within a plane substantially parallel to plane 17 (e.g., substantially horizontal) between a closed position, an intermediate position, and a fully opened position. A pair of linear slides 284 facilitates sliding movement of the top frame 282. Each linear slide 284 illustratively includes a stationary rail 286 and a carriage 288 operably coupled to the rail 286 for linear movement therealong. Each stationary rail 286 is fixed to one of the side frames 232, 234, while the carriages 288 are fixed to the top frame 282. Bearing members, such as ball bearings (not shown) may be positioned intermediate the stationary rail 286 and the carriage 288 to facilitate relative movement therebetween.

A locking device 290 is operably coupled to the linear slide 284 and is configured to secure the top frame 282 in a selected one of the closed, intermediate, and fully opened positions. The locking device 290 illustratively includes a spring biased pin (not shown) configured to engage recesses in one of the carriages 288 of the linear slide 284. A pull handle 292 may be coupled to the pin for releasing the pin from the selected recess in the linear slide 284.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A vehicle protective structure comprising:

a first portion configured to be coupled to an upper section of a vehicle including an opening;

a second portion operably coupled to the first portion, the second portion including a first side frame, a second side frame, and an end frame connected between the first side frame and the second side frame to at least partially enclose a perimeter, and at least one ballistic window supported within each of the first side frame, the second side frame, and the end frame, the at least on ballistic window including a front driver side window supported within the first side frame, a front curb side window supported within the second side frame, and an end window supported within the end frame; and a third portion supported by the second portion, the third portion including:

a first movable frame supported above the first side frame of the second portion for pivoting movement between a plurality of positions, including a closed position and an open position outward from the closed position, a first biasing device operably coupled to the first movable frame, a first locking device configured to secure the first moveable frame in a selected one of the plurality of positions, a second movable frame supported above the second side frame of the second portion and supported for pivoting movement between a plurality of positions, including a closed position and an open position outward from the closed position, a second biasing device operably coupled to the second movable frame, a second locking device configured to secure the second moveable frame in a selected one of the plurality of positions, at least one ballistic window supported within each of the first movable frame and the second movable frame.

2. The vehicle protective structure of claim 1, wherein:

the first movable frame is supported for pivoting movement in a counter-clockwise direction from the first open position to a second open position, the first biasing device providing first biasing torques to the first movable frame when positioned intermediate the closed position and the first open position and second biasing torques to the first movable frame when positioned intermediate the first open position and the second open position, the first biasing torques being greater than the second biasing torques; and the second movable frame is supported for pivoting movement in a clockwise direction from the first open position to a second open position, the second biasing device providing first biasing torques to the second movable frame when positioned intermediate the closed position and the first open position and second biasing torques to the second movable frame when positioned intermediate the first open position and the second open position, the first biasing torques being greater than the second biasing torques.

3. The vehicle protective structure of claim 2, wherein:

the first movable frame is supported for pivoting movement in a counter-clockwise direction from the second open position to a third open position, the first biasing device providing third biasing torques to the first movable frame when positioned intermediate the second open position and the third open position, the third biasing torques tending to bias the first movable frame in a direction opposite that of the second biasing torques; and the second movable frame is supported for pivoting movement in a clockwise direction from the second open position to a third open position, the second biasing device providing third biasing torques to the second movable frame when positioned intermediate the second open position and the third open position, the third biasing torques tending to bias the second movable frame in a direction opposite that of the second biasing torques.

4. The vehicle protective structure of claim 1, wherein the first locking device and the second locking device each comprises:

a rotatable index member operably coupled to one of the first movable frame and the second movable frame, the rotatable index member including a plurality of recesses associated with the plurality of positions of the movable frame; and a pin configured to be releasably received within one of the recesses of the index member.

5. The vehicle protective structure of claim 1, further comprising:

a top frame supported by the first side frame and the second side frame of the third portion;

a ballistic window supported within the top frame; and a linear slide operably coupled to the top frame to provide sliding movement of the top frame between a closed position and an open position.

6. The vehicle protective structure of claim 5, further comprising a top frame locking device configured to secure the top frame in one of a plurality of positions including the closed position and the open position.

7. The vehicle protective structure of claim 1, wherein each of the first biasing device and the second biasing device comprises a torsion spring.

8. The vehicle protective structure of claim 1, further comprising a traversal portion operably coupled to the first portion, the traversal portion configured to rotate the first portion relative to the vehicle opening.

9. The vehicle protective structure of claim 1, wherein the first movable frame and the second movable frame of the third portion in the closed positions define a front opening, the vehicle protective structure further comprising a shield disposed adjacent the front opening.

10. The vehicle protective structure of claim 9, wherein the shield includes an elongated opening for receiving the barrel of a weapon, and at least one ballistic window.

11. The vehicle protective structure of claim 1, wherein the first and second movable frames of the third portion in the closed positions extend upwardly and inwardly towards a center of the vehicle opening, and laterally inwardly toward each other.

* * * * *